US010619613B2

(12) United States Patent
Noguchi

(10) Patent No.: US 10,619,613 B2
(45) Date of Patent: Apr. 14, 2020

(54) NOZZLE PLATE FOR FUEL INJECTION DEVICE

(71) Applicant: ENPLAS CORPORATION, Saitama (JP)

(72) Inventor: Koji Noguchi, Saitama (JP)

(73) Assignee: ENPLAS CORPORATION, Saitama (JP)

( * ) Notice: Subject to any disclaimer, the term of this patent is extended or adjusted under 35 U.S.C. 154(b) by 190 days.

(21) Appl. No.: 15/542,291

(22) PCT Filed: Dec. 21, 2015

(86) PCT No.: PCT/JP2015/085605
§ 371 (c)(1),
(2) Date: Jul. 7, 2017

(87) PCT Pub. No.: WO2016/111149
PCT Pub. Date: Jul. 14, 2016

(65) Prior Publication Data

US 2018/0266377 A1 Sep. 20, 2018

(30) Foreign Application Priority Data

Jan. 9, 2015 (JP) ..... 2015-003316

(51) Int. Cl.
*F02M 61/18* (2006.01)
*F02M 61/16* (2006.01)
*F02B 23/10* (2006.01)

(52) U.S. Cl.
CPC ..... *F02M 61/1853* (2013.01); *F02M 61/162* (2013.01); *F02M 61/18* (2013.01);
(Continued)

(58) Field of Classification Search
CPC .. F02M 61/18; F02M 61/185; F02M 61/1833; F02M 61/184; F02M 61/162;
(Continued)

(56) References Cited

U.S. PATENT DOCUMENTS 5,570,841 A 11/1996 Pace et al.
5,924,634 A 7/1999 Arndt et al.
(Continued)

FOREIGN PATENT DOCUMENTS

JP 10-502131 2/1998
JP 10-507240 7/1998
(Continued)

OTHER PUBLICATIONS

International Search Report dated Mar. 1, 2016 in International (PCT) Application No. PCT/JP2015/085605.

*Primary Examiner* — Arthur O. Hall
*Assistant Examiner* — Tuongminh N Pham
(74) *Attorney, Agent, or Firm* — Wenderoth, Lind & Ponack, L.L.P.

(57) ABSTRACT

A nozzle hole of a nozzle plate is coupled to a fuel injection port of a fuel injection device via a swirl chamber and first and second fuel guide channels opened into the swirl chamber. The swirl chamber is formed by combining first and second elliptical-shaped recessed portions. The first fuel guide channel opens at a side of a short axis of the first elliptical-shaped recessed portion and a side of the short axis that does not overlap with the second elliptical-shaped recessed portion, and the second fuel guide channel opens at a side of a short axis of the second elliptical-shaped recessed portion and a side of the short axis that does not overlap with the first elliptical-shaped recessed portion. The first and second fuel guide channels have depths deeper than those of
(Continued)

the swirl chamber and extend inside of the swirl chamber while gradually reducing cross-sectional areas.

16 Claims, 17 Drawing Sheets

(52) U.S. Cl.
CPC ..... *F02M 61/184* (2013.01); *F02M 61/1833* (2013.01); *F02B 23/104* (2013.01)

(58) Field of Classification Search
CPC ..... F02M 61/1853; F02M 61/1846; F02M 61/08; F02M 61/047; F02B 23/104; B05B 1/3426; B05B 1/3463
See application file for complete search history.

(56) References Cited

U.S. PATENT DOCUMENTS

| | | | |
|---|---|---|---|
| 2004/0104285 | A1 | 6/2004 | Okamoto et al. |
| 2004/0217204 | A1 | 11/2004 | Sugimoto et al. |

FOREIGN PATENT DOCUMENTS

| | | |
|---|---|---|
| JP | 2004-176690 | 6/2004 |
| JP | 2004-340121 | 12/2004 |
| JP | 2006-220017 | 8/2006 |
| JP | 2012-193713 | 10/2012 |
| WO | 96/11335 | 4/1996 |
| WO | 2014/185290 | 11/2014 |

A1
B1
X
Y
Z

NOZZLE PLATE FOR FUEL INJECTION DEVICE

TECHNICAL FIELD

The present invention relates to a nozzle plate for a fuel injection device (hereinafter abbreviated as a nozzle plate as necessary), which is mounted on a fuel injection port of the fuel injection device, and injects fuel flowed out from the fuel injection port after atomizing the fuel.

BACKGROUND ART

An internal combustion engine (hereinafter abbreviated as "engine") of an automobile or the like is configured such that a combustible mixed gas is formed by mixing fuel injected from a fuel injection device and air introduced into the engine through an intake pipe, and the combustible mixed gas is burned in the inside of the cylinder. It has been known that, in such an engine, a mixing state of the fuel injected from the fuel injection device and the air largely influences the performance of the engine. Particularly, it has been known that the atomization of the fuel injected from the fuel injection device becomes an important factor, which influences the performance of the engine.

Such a fuel injection device, in order to ensure the atomization of the fuel in spraying, is configured such that a nozzle plate is mounted on a fuel injection port of a valve body to inject the fuel from a plurality of fine nozzle holes formed on this nozzle plate.

FIG. 15 shows such a conventional nozzle plate 100. This nozzle plate 100 shown in FIG. 15 has a laminated structure formed such that a first nozzle plate 101 and a second nozzle plate 102 are laminated. Then, as shown in FIG. 15 and FIG. 16, at the first nozzle plate 101, a pair of first nozzle holes 103A and 103B, which pass through front and rear surfaces of the first nozzle plate 101, are formed at positions on a center line 104, which extends along a Y-axis, and positions that are mutually line-symmetric with respect to a center line 105, which extends along an X-axis. As shown in FIG. 15 and FIG. 17, at the second nozzle plate 102, a pair of second nozzle holes 106A and 106B are formed at positions on the center line 105, which extends along an X-axis direction, and positions that are mutually line-symmetric with respect to the center line 104, which extends along the Y-axis. These pair of second nozzle holes 106A and 106B are communicated with the first nozzle holes 103A and 103B via a pair of curving channels 108A and 108B (a first curving channel 108A and a second curving channel 108B) formed at a side of a surface (front surface) 107 bumped against the first nozzle plate 101. At the second nozzle plate 102, the pair of curving channels 108A and 108B are communicated with one another by a communication channel 110, which extends along the center line 104.

The conventional nozzle plate 100 shown in FIG. 15 guides the fuel injected from the fuel injection port of the valve body into the curving channels 108A and 108B from the first nozzle holes 103A and 103B, and while performing a swirling movement to the fuel flowed into the curving channels 108A and 108B by the curving channels 108A and 108B, flows the fuel outside from the second nozzle holes 106A and 106B to ensure improvement of a quality of the fuel atomization (see Japanese Unexamined Patent Application Publication No. 10-507240).

However, as shown in FIG. 15 and FIG. 17, at the conventional nozzle plate 100, a part of the first curving channel 108A and a part of the second curving channel 108B are directly opened into the second nozzle hole 106A (106B). Thus, a part of the fuel that flows in the first curving channel 108A and the second curving channel 108B flows out to the second nozzle hole 106A (106B) without sufficiently swirling around the second nozzle hole 106A (106B). Accordingly, a sufficient swirling force is not applied to the fuel that flows out from the first curving channel 108A and the second curving channel 108B to the second nozzle hole 106A (106B), and the swirling force and a flow rate of the fuel that flows in the second nozzle hole 106A (106B) become insufficient. Thus, miniaturization and homogenization of fuel microparticles in spraying are insufficiently generated by injection of the fuel from the second nozzle hole 106A (106B).

Therefore, an object of the present invention is to provide a nozzle plate that ensures further minute fuel microparticles in spraying generated by injection of fuel from a nozzle hole and ensures the further homogeneous fuel microparticles in spraying.

SUMMARY OF THE INVENTION

The present invention relates to a nozzle plate for a fuel injection device 3 disposed opposed to a fuel injection port 5 of a fuel injection device 1. The nozzle plate has a plurality of nozzle holes 6 through which fuel injected from the fuel injection port 5 passes. According to the present invention, the nozzle holes 6 are coupled to the fuel injection port 5 via a swirl chamber 13, a first fuel guide channel 18, and a second fuel guide channel 20. The first fuel guide channel 18 and the second fuel guide channel 20 open into the swirl chamber 13. The swirl chamber 13 has a shape formed by combining a first elliptical-shaped recessed portion 26 formed at a side of a surface opposed to the fuel injection port 5 with a second elliptical-shaped recessed portion 27 having a size identical to a size of the first elliptical-shaped recessed portion 26. A center 27*a* of the second elliptical-shaped recessed portion 27 is displaced from a center 26*a* of the first elliptical-shaped recessed portion 26, the first elliptical-shaped recessed portion 26 partially overlaps with the second elliptical-shaped recessed portion 27, and the first fuel guide channel 18 opens at a first end portion side of a major or minor axis of the first elliptical-shaped recessed portion 26 and at a first end portion side of the major or minor axis of the first elliptical-shaped recessed portion 26 that does not overlap with the second elliptical-shaped recessed portion 27. The second fuel guide channel 20 opens at a first end portion side of a major or minor axis of the second elliptical-shaped recessed portion 27 and at a first end portion side of the major or minor axis of the second elliptical-shaped recessed portion 27 that does not overlap with the first elliptical-shaped recessed portion 27. The nozzle hole 6 is positioned at a middle of an imaginary straight line that couples the center 26*a* of the first elliptical-shaped recessed portion 26 to the center 27*a* of the second elliptical-shaped recessed portion 27, and a side of the first elliptical-shaped recessed portion 26 and a side of the second elliptical-shaped recessed portion 27 have a dyad symmetry with respect to the middle 17 of the imaginary straight line 16 (i.e., have rotational symmetry about a center of each of the nozzle holes). The first fuel guide channel 18 has a channel depth deeper than a depth of the first elliptical-shaped recessed portion 26, and extends while gradually reducing a channel cross-sectional area along a sidewall 35 of the first elliptical-shaped recessed portion 26 from a part opened into the first elliptical-shaped recessed portion 26 to an inside of the first elliptical-shaped recessed portion 26.

The second fuel guide channel 20 has a channel depth deeper than a depth of the second elliptical-shaped recessed portion 27, and extends while gradually reducing a channel cross-sectional area along a sidewall 38 of the second elliptical-shaped recessed portion 27 from a part opened into the second elliptical-shaped recessed portion 27 to an inside of the second elliptical-shaped recessed portion 27. The fuel flowing into the swirl chamber 13 from the first and second fuel guide channels 18 and 20 is introduced into the nozzle holes 6 while being swirled in an identical direction inside the swirl chamber 13.

Effects of the Invention

According to the present invention having the configuration as described above, fuel introduced into an inside of a swirl chamber by first and second fuel guide channels is flowed and narrowed down in a direction (an identical swirling direction) along a sidewall of the swirl chamber by parts positioned in the swirl chamber among the first and second fuel guide channels to increase a flow rate. Furthermore, in the swirl chamber, the fuel from the first fuel guide channel and the fuel from the second fuel guide channel act on one another when swirling in the identical direction to increase a swirling velocity and a swirling force. Accordingly, the nozzle plate of the present invention, compared with a nozzle plate where first and second fuel guide channels do not extend to an inside of a swirl chamber and a nozzle plate of a conventional example, can reduce variation of spray generated by injection of the fuel from nozzle holes since a velocity component increases in the swirling direction of the fuel that passes through the nozzle holes and the fuel injected from the nozzle hole is formed into thin films, thus ensuring further fine and homogeneous spray.

BRIEF DESCRIPTION OF THE DRAWINGS

FIGS. 2A-2E are views showing the nozzle plate according to the first embodiment of the present invention, in which FIG. 2A is a front view of the nozzle plate, FIG. 2B is a cross-sectional view of the nozzle plate taken along a line A1-A1 in FIG. 2A, FIG. 2C is a back view of the nozzle plate, FIG. 2D is an enlarged view of a portion B1 in FIG. 2B, and FIG. 2E is an enlarged view showing a part of FIG. 2C.

FIGS. 3A-3C are detailed views of a swirl chamber of the nozzle plate according to the first embodiment of the present invention, in which FIG. 3A is a plan view of the swirl chamber, FIG. 3B is a cross-sectional view of the swirl chamber taken along a line A2-A2 in FIG. 3A, and FIG. 3C is a cross-sectional view of the swirl chamber taken along a line A3-A3 in FIG. 3A.

FIGS. 5A-5C are views showing a nozzle plate according to a modification 1 of the first embodiment of the present invention, in which FIG. 5A is a front view of the nozzle plate, FIG. 5B is a cross-sectional view of the nozzle plate taken along a line A4-A4 in FIG. 5A, and FIG. 5C is a back view of the nozzle plate.

FIGS. 7A-7C are detailed views of a swirl chamber of a nozzle plate according to a modification 2 of the first embodiment of the present invention, in which FIG. 7A is a plan view of the swirl chamber, FIG. 7B is a cross-sectional view taken along a line A5-A5 in FIG. 7A, and FIG. 7C is a cross-sectional view taken along a line A6-A6 in FIG. 7.

FIGS. 8A-8C are detailed views of a swirl chamber of a nozzle plate according to a second embodiment of the present invention, in which FIG. 8A is a plan view of the swirl chamber, FIG. 8B is a cross-sectional view of the swirl chamber taken along a line A7-A7 in FIG. 8A, and FIG. 8C is a cross-sectional view of the swirl chamber taken along a line A8-A8 in FIG. 8A.

FIGS. 9A-9C are detailed views of a swirl chamber of a nozzle plate according to a third embodiment of the present invention, in which FIG. 9A is a plan view of the swirl chamber, FIG. 9B is a cross-sectional view of the swirl chamber taken along a line A9-A9 in FIG. 9A, and FIG. 9C is a cross-sectional view of the swirl chamber taken along a line A10-A10 in FIG. 9A.

FIGS. 10A-10C are detailed views of a swirl chamber of a nozzle plate according to a fourth embodiment of the present invention, in which FIG. 10A is a plan view of the swirl chamber, FIG. 10B is a cross-sectional view of the swirl chamber taken along a line A11-A11 in FIG. 10A, and FIG. 10C is a cross-sectional view of the swirl chamber taken along a line A12-A12 in FIG. 10A.

FIGS. 11A-11C are detailed views of a swirl chamber of a nozzle plate according to a fifth embodiment of the present invention, in which FIG. 11A is a plan view of the swirl chamber, FIG. 11B is a cross-sectional view of the swirl chamber taken along a line A13-A13 in FIG. 11A, and FIG. 11C is a cross-sectional view of the swirl chamber taken along a line A14-A14 in FIG. 11A.

FIGS. 12A-12C are detailed views of a swirl chamber of a nozzle plate according to a sixth embodiment of the present invention, in which FIG. 12A is a plan view of the swirl chamber, FIG. 12B is a cross-sectional view of the swirl chamber taken along a line A15-A15 in FIG. 12A, and FIG. 12C is a cross-sectional view of the swirl chamber taken along a line A16-A16 in FIG. 12A.

FIGS. 13A-13C are detailed views of a swirl chamber of a nozzle plate according to a seventh embodiment of the present invention, in which FIG. 13A is a plan view of the swirl chamber, FIG. 13B is a cross-sectional view of the swirl chamber taken along a line A17-A17 in FIG. 13A, and FIG. 13C is a cross-sectional view of the swirl chamber taken along a line A18-A18 in FIG. 13A.

FIGS. 14A-14C are detailed views of a swirl chamber of a nozzle plate according to an eighth embodiment of the present invention, in which FIG. 14A is a plan view of the swirl chamber, FIG. 14B is a cross-sectional view of the swirl chamber taken along a line A19-A19 in FIG. 14A, and FIG. 14C is a cross-sectional view of the swirl chamber taken along a line A20-A20 in FIG. 14A.

FIG. 15A is a front view of the nozzle plate, and FIG. 15B is a cross-sectional view of the nozzle plate taken along a line A21-A21 in FIG. 15A.

FIG. 16A is a front view of the first nozzle plate, and FIG. 16B is a cross-sectional view of the first nozzle plate taken along a line A22-A22 in FIG. 16A.

FIG. 17A is a front view of the second nozzle plate, and FIG. 17B is a cross-sectional view of the second nozzle plate taken along a line A23-A23 in FIG. 17A.

DESCRIPTION OF PREFERRED EMBODIMENTS

Embodiments of the present invention are described in detail by reference to drawings hereinafter.

First Embodiment

Figure 1:
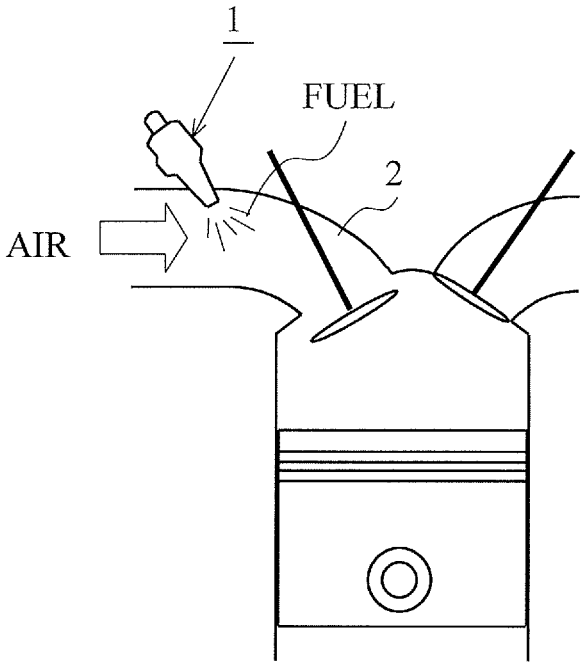
FIG. 1 is a view schematically showing an in-use state of a fuel injection device on which a nozzle plate for a fuel injection device according to a first embodiment of the present invention is mounted.

FIG. 1 is a view schematically showing an in-use state of a fuel injection device 1 on which a nozzle plate according to a first embodiment of the present invention is mounted. As shown in FIG. 1, the fuel injection device 1 of a port injection method is mounted in a middle portion of an intake pipe 2 of an engine, and is configured to generate a combustible mixed gas by injecting fuel into the inside of the intake pipe 2 and mixing air and the fuel introduced into the intake pipe 2.

Figures 2A, 2B, 2C, 2D, 2E:
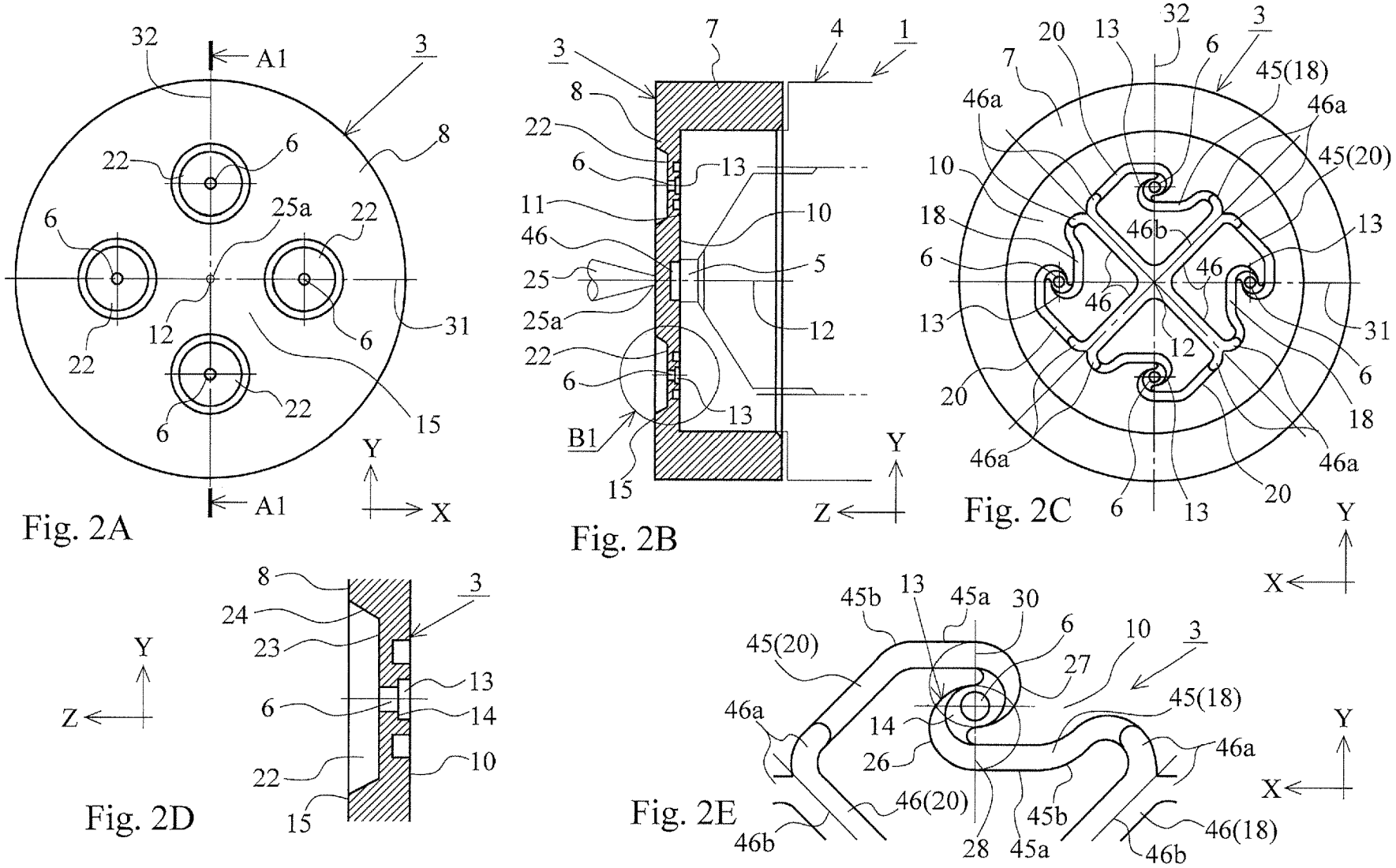

FIG. 2 are views showing a nozzle plate 3 according to the first embodiment of the present invention. FIG. 2A is a front view of the nozzle plate 3, FIG. 2B is a cross-sectional view of the nozzle plate 3 taken along a line A1-A1 in FIG. 2A, FIG. 2C is a back view of the nozzle plate 3, FIG. 2D is an enlarged view of a portion B1 in FIG. 2B, and FIG. 2E is an enlarged view showing a part of the nozzle plate 3 in FIG. 2C.

As shown in FIG. 2, the nozzle plate 3, which is mounted on a distal end of a valve body 4 of the fuel injection device 1, is configured to spray the fuel injected from a fuel injection port 5 of the valve body 4 from a plurality of (four in this embodiment) nozzle holes 6 to a side of the intake pipe 2. This nozzle plate 3 is a bottomed cylindrical body made of a synthetic resin material (for example, PPS, PEEK, POM, PA, PES, PEI, and LCP) which is constituted of a circular cylindrical fitted portion 7 and a plate body portion 8 which is integrally formed with one end side of the circular cylindrical fitted portion 7. Then, the circular cylindrical fitted portion 7 of the nozzle plate 3 is fitted on an outer periphery of the valve body 4 on a distal end side without a gap, and is fixed to the valve body 4 in a state where an inner surface 10 of the plate body portion 8 is brought into contact with a distal end surface 11 of the valve body 4.

The plate body portion 8, which is formed into a circular-plate shape, has a central axis 12. On an identical circumference around the central axis 12, a plurality of (four) nozzle holes 6 are formed at regular intervals. This nozzle hole 6 is formed such that one end opens into a bottom surface 14 of a swirl chamber 13 formed at a side of the surface (inner surface) 10 opposed to the fuel injection port 5 of the plate body portion 8 and another end opens at a side of an outer surface 15 (a surface positioned at a side opposed to the inner surface 10) of the plate body portion 8. When the inner surface 10 of the plate body portion 8 is viewed in plan view, the nozzle hole 6 is formed as positioned at a middle 17 of an imaginary straight line 16 that couples a center 26*a* of a first elliptical-shaped recessed portion 26 to a center 27*a* of a second elliptical-shaped recessed portion 27, which are described later (formed at a position that bisects the imaginary straight line 16). Then, the nozzle hole 6 is coupled to the fuel injection port 5 of the valve body 4 via the swirl chamber 13, and first and second fuel guide channels 18 and 20. Therefore, the fuel injected from the fuel injection port 5 is introduced into the nozzle hole 6 via the first and second fuel guide channels 18 and 20 and the swirl chamber 13.

At the side of the outer surface 15 of the plate body portion 8, bottomed recesses 22 that are concentric with centers of the nozzle holes 6 are formed. This recess 22 is formed such that a bottom surface 23 has an outside diameter larger than that of the nozzle hole 6, and a taper-shaped inner surface 24 expands from the bottom surface 23 toward an outward of the bottomed recess 22. This recess 22 is formed such that the spray generated by injecting the fuel from the nozzle hole 6 does not impinge on the taper-shaped inner surface 24. At a middle of the plate body portion 8, a separation mark 25*a* of a gate 25 is formed.

Figure 3A:
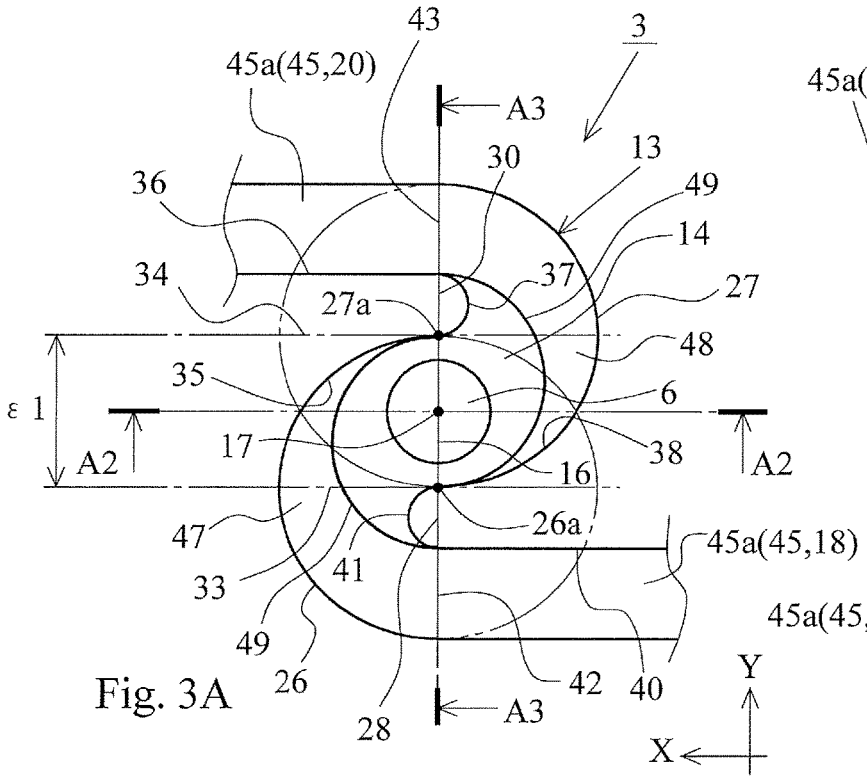
Figure 3C:
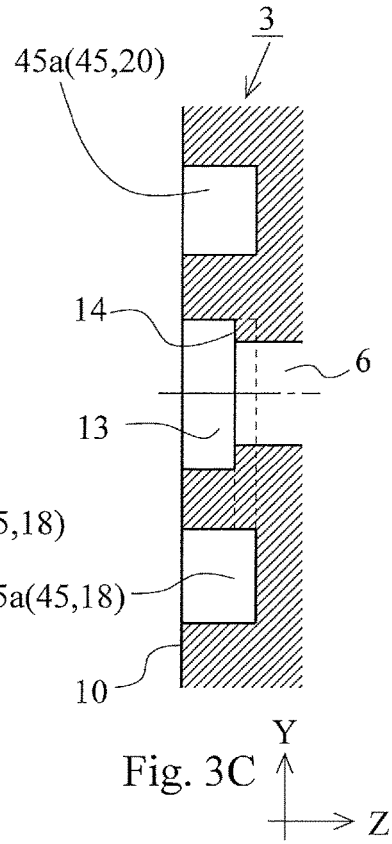
Figure 3B:
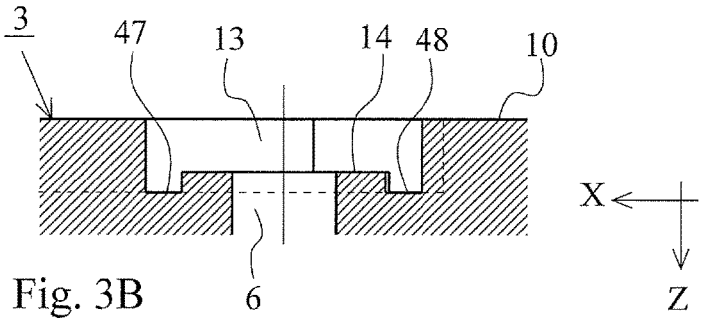

As shown in FIG. 2 and FIG. 3, the swirl chamber 13 has a shape as formed by combining the first elliptical-shaped recessed portion 26, which is a recess formed at the inner surface 10 side of the plate body portion 8 (at a side of a surface opposed to the fuel injection port 5), with the second elliptical-shaped recessed portion 27, which is a recess that has a size identical to a size of the first elliptical-shaped recessed portion 26 (has an identical planar shape and an identical depth from the inner surface 10). Then, a short axis 28 of the first elliptical-shaped recessed portion 26 and a short axis 30 of the second elliptical-shaped recessed portion 27 are positioned on a center line 31, which passes through a center of the plate body portion 8 and is parallel to an X-axis, or a center line 32, which passes through the center of the plate body portion 8 and is parallel to a Y-axis. That is, the short axis 30 of the second elliptical-shaped recessed portion 27 is disposed on an extended line of the short axis 28 of the first elliptical-shaped recessed portion 26 (on the center line 31 or on the center line 32), and the center 27*a* (an intersection point of the short axis 30 and a long axis 34) of the second elliptical-shaped recessed portion 27 is disposed displaced from the center 26*a* (an intersection point of the short axis 28 and a long axis 33) of the first elliptical-shaped recessed portion 26 by a predetermined dimension (ε1). Then, at this swirl chamber 13, the first elliptical-shaped recessed portion 26 partially overlaps with the second elliptical-shaped recessed portion 27, a first fuel guide channel 18 opens at an end portion side of the short axis 28 of the first elliptical-shaped recessed portion 26 and at an end portion side of the short axis 28 of the first elliptical-shaped recessed portion 26 that does not overlap with the second elliptical-shaped recessed portion 27, and a second fuel guide channel 20 opens at an end portion side of the short axis 30 of the second elliptical-shaped recessed portion 27 and at an end portion side of the short axis 30 of the second elliptical-shaped recessed portion 27 that does not overlap with the first elliptical-shaped recessed portion 26.

At elliptical shapes when the first and second elliptical-shaped recessed portions 26 and 27 are viewed in plan view, one main axes are the short axes 28 and 30, and other main axes are the long axes 33 and 34. This embodiment has described an example where the short axis 30 of the second elliptical-shaped recessed portion 27 was disposed on the extended line of the short axis 28 of the first elliptical-shaped recessed portion 26. However, the present invention is not limited to such configuration of this embodiment. The present invention also includes configurations of respective embodiments and respective modifications described later.

As shown in FIG. 3, the first elliptical-shaped recessed portion 26 of the swirl chamber 13 has a sidewall 35 coupled to a channel sidewall 36 of the second fuel guide channel 20 near the first elliptical-shaped recessed portion 26 by a smooth curved surface 37 (a curved surface whose shape in plan view is a semicircle that is convex inward the swirl chamber 13). This curved surface 37 is coupled to the sidewall 35 of the first elliptical-shaped recessed portion 26 on the short axis 30 of the second elliptical-shaped recessed portion 27, and is coupled to the channel sidewall 36 of the second fuel guide channel 20 near the first elliptical-shaped recessed portion 26 on the short axis 30 of the second elliptical-shaped recessed portion 27. The second elliptical-shaped recessed portion 27 of the swirl chamber 13 has a sidewall 38 coupled to a channel sidewall 40 of the first fuel guide channel 18 near the second elliptical-shaped recessed portion 27 by a smooth curved surface 41 (a curved surface whose shape in plan view is a semicircle that is convex inward the swirl chamber 13). This curved surface 41 is coupled to the sidewall 38 of the second elliptical-shaped recessed portion 27 on the short axis 28 of the first elliptical-shaped recessed portion 26, and is coupled to the channel sidewall 40 of the first fuel guide channel 18 near the second elliptical-shaped recessed portion 27 on the short axis 28 of the first elliptical-shaped recessed portion 26. Accordingly, the first fuel guide channel 18 has an opening portion (coupling portion) 42 into the swirl chamber 13. The opening portion 42 is on the short axis 28 of the first elliptical-shaped recessed portion 26. The second fuel guide channel 20 has an opening portion (coupling portion) 43 into the swirl chamber 13. The opening portion 43 is on the short axis 30 of the second elliptical-shaped recessed portion 27. Then, when the swirl chamber 13 is viewed in plan view, the opening portion 42 of the first fuel guide channel 18 into the first elliptical-shaped recessed portion 26 (the swirl chamber 13) and the opening portion 43 of the second fuel guide channel 20 into the second elliptical-shaped recessed portion 27 (the swirl chamber 13) are positioned to have a dyad symmetry with respect to the middle 17 of the imaginary straight line 16. Intervals between the sidewalls 35 and 38 of the swirl chamber 13 and the nozzle hole 6 are formed to become narrowest (smallest) on the short axes 28 and 30 of the first and second elliptical-shaped recessed portions 26 and 27 (a coupling portion of the sidewall 35 to the curved surface 37, and a coupling portion of the sidewall 38 to the curved surface 41). As a result, a flow of the fuel that performs a swirling movement inside the first elliptical-shaped recessed portion 26 and a flow of the fuel that performs the swirling movement inside the second elliptical-shaped recessed portion 27 act on one another to increase a swirling velocity of the fuel inside the swirl chamber 13.

As shown in FIG. 2 and FIG. 3, the first and second fuel guide channels 18 and 20 include first fuel guide channel portions 45 coupled to the swirl chambers 13 and second fuel guide channel portions 46 that guide the fuel injected from the fuel injection ports 5 to the first fuel guide channel portions 45. The first fuel guide channel portion 45 of the first fuel guide channel 18 and the first fuel guide channel portion 45 of the second fuel guide channel 20 are formed deeper than the swirl chambers 13 and formed having identical channel depths, formed such that lengths of flow passages from coupling portions to the second fuel guide channel portions 46 (branch channel parts 46*a* of the second fuel guide channel portions 46) to the opening portions 42 into the swirl chambers 13 have identical dimensions, and formed such that parts from the coupling portions to the second fuel guide channel portions 46 (the branch channel parts 46*a* of the second fuel guide channel portions 46) to the opening portions 42 into the swirl chambers 13 have identical channel widths. The first fuel guide channel portion 45 coupled to one of adjacent swirl chambers 13, 13 and the first fuel guide channel portion 45 coupled to another of the adjacent swirl chambers 13, 13 are coupled to a common second fuel guide channel portion 46. The second fuel guide channel portions 46 are formed at four positions at regular intervals radially from a middle at the inner surface 10 side of the plate body portion 8. Then, the second fuel guide channel portions 46 at four positions are formed into identical shapes. That is, the second fuel guide channel portions 46 at four positions are formed to have the identical lengths of the flow passages from the middle at the inner surface 10 side of the plate body portion 8 to the first fuel guide channel portions 45, the identical channel widths, and the identical channel depths. The pair of branch channel parts 46*a*, 46*a* of the second fuel guide channel portion 46 have linearly symmetrical shapes with respect to a center line 46*b* of the channel width of the second fuel guide channel portion 46 as a symmetry axis. Such first and second fuel guide channels 18 and 20 can flow the fuel injected from the fuel injection port 5 into the swirl chamber 13 by identical amounts.

As shown in FIG. 2 and FIG. 3, the first fuel guide channel portion 45 includes a swirl-chamber-side coupling portion 45*a* (a straight-line part) that opens into the swirl chamber 13 as being perpendicular to the short axes 28 and 30 of the swirl chamber 13, and a curved flow passage part 45*b* such that a centrifugal force in a direction separating from the middle 17 of the imaginary straight line 16 acts on the fuel that flows into the swirl chamber 13. Here, when the inner surface 10 is viewed in plan view, the curved flow passage part 45*b* of the first fuel guide channel 18 coupled to the swirl chamber 13 at an inward end side in a radial direction is formed into a curved shape that is convex inward in the radial direction of the inner surface 10. When the inner surface 10 is viewed in plan view, the curved flow passage part 45*b* of the second fuel guide channel 20 coupled to the swirl chamber 13 at an outward end side in the radial direction is formed into a curved shape that is convex outward in the radial direction of the inner surface 10. As a result, the fuel flowed into the swirl chamber 13 from the first fuel guide channel 18 and the second fuel guide channel 20 has a sufficient amount to swirl along the shapes of the sidewalls 35 and 38 of the swirl chamber 13.

As shown in FIG. 2 and FIG. 3, the first and second fuel guide channels 18 and 20 are disposed to extend to an inside of the swirl chamber 13 from the opening portions 42 and 43 into the swirl chamber 13. That is, the first fuel guide channel 18 includes a part (a first in-in-swirl-chamber fuel guide channel portion) 47 disposed to extend while gradually reducing the channel width (channel cross-sectional area) from the opening portion 42 into the first elliptical-shaped recessed portion 26 to an inside of the first elliptical-shaped recessed portion 26 (from one end to another end of the short axis 28 of the first elliptical-shaped recessed portion 26) along the sidewall 35 of the first elliptical-shaped recessed portion 26. The second fuel guide channel 20 includes a part (a second in-swirl-chamber fuel guide channel portion) 48 disposed to extend while gradually reducing the channel width (channel cross-sectional area) from the opening portion 43 into the second elliptical-shaped recessed portion 27 to an inside of the second elliptical-shaped recessed portion 27 (from one end to another end of the short axis 30 of the second elliptical-shaped recessed portion 27) along the sidewall 38 of the second elliptical-shaped recessed portion 27. Then, when the swirl chamber 13 is viewed in plan view, the first in-swirl-chamber fuel guide channel portion 47 and the second in-swirl-chamber fuel guide channel portion 48 are formed to have a dyad symmetry with respect to the middle 17 of the imaginary straight line 16. When these first in-swirl-chamber fuel guide channel portion 47 and second in-swirl-chamber fuel guide channel portion 48 are viewed in plan view, internal surfaces 49 at a side of the nozzle hole 6 have smooth arc shapes (arc shapes that are convex in directions identical to the sidewalls 35 and 38, and for example, in a case of a true circle, a circular arc that is a part of the true circle, and in a case of an ellipse, an elliptical arc that is a part of the ellipse). Such first and second in-swirl-chamber fuel guide channel portions 47 and 48 improve the flow in a tangential direction of the nozzle hole 6, of the fuel supplied into the swirl chamber 13 from the first fuel guide channel portions 45, 45 to reduce the flow in a normal direction toward the nozzle hole 6, thus guiding the fuel into the inside of the swirl chamber 13 (parts where the intervals between the sidewalls 35 and 38 of the swirl chamber 13 and the nozzle hole 6 become narrowest) along the sidewalls 35 and 38 of the swirl chamber 13. Then, the flow of the fuel from sides of the first and second in-swirl-chamber fuel guide channel portions 47 and 48 toward the nozzle hole 6 is narrowed down to accelerate by the first and second in-swirl-chamber fuel guide channel portions 47 and 48, which are configured to gradually reduce the channel width, since the first and second in-swirl-chamber fuel guide channel portions 47 and 48 are formed deeper than the swirl chamber 13 (having depths identical to those of the first and second fuel guide channels 18 and 20).

Figure 4:
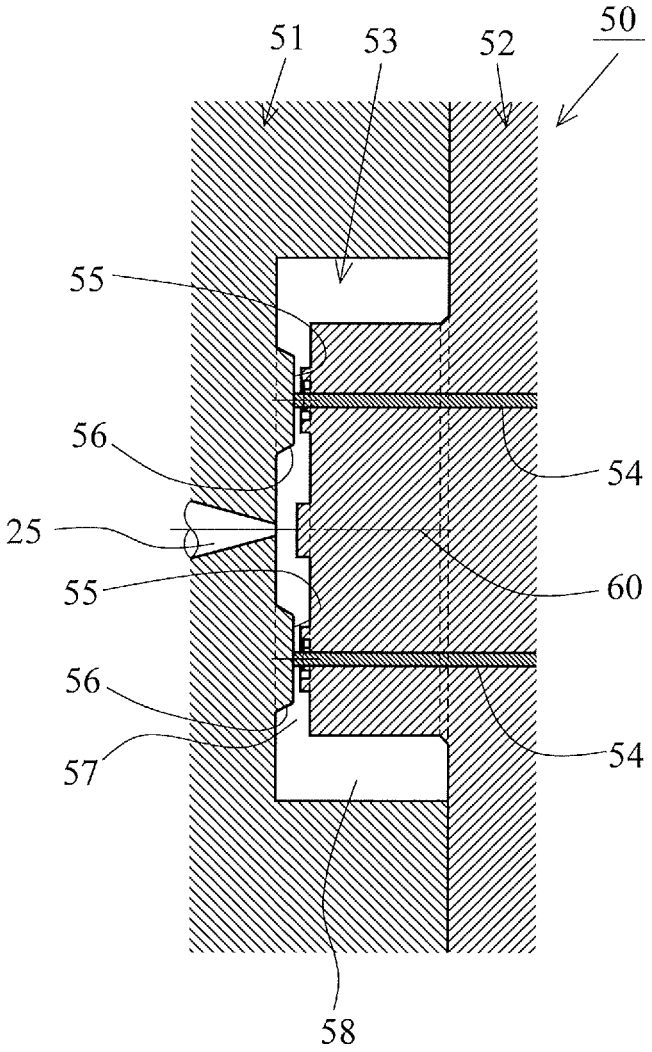
FIG. 4 is a cross-sectional view of a mold for injection molding of the nozzle plate according to the first embodiment of the present invention.

FIG. 4 is a view showing a mold structure for injection molding of the nozzle plate 3 according to the embodiment. A mold 50 shown in FIG. 4 has a cavity 53 formed between a first mold 51 and a second mold 52, and nozzle hole forming pins 54 for forming the nozzle holes 6. The nozzle hole forming pins 54 project inside the cavity 53. The nozzle hole forming pin 54 has a distal end bumped against a cavity inner surface 55 of the first mold 51. The first mold 51 has positions against which the nozzle hole forming pins 54 are bumped. These positions are convex portions 56 for forming the bottomed recesses 22. The cavity 53 is constituted of a first cavity part 57, which forms the plate body portion 8, and a second cavity part 58, which forms the circular cylindrical fitted portion 7. Then, the gate 25, which injects a molten resin into the cavity 53, opens into a center of the first cavity part 57. A center of an opening portion of the gate 25 is positioned on a central axis 60 of the cavity 53, and positioned equidistant from the centers of the plurality of nozzle holes 6 (centers of the nozzle hole forming pins 54).

In such mold 50, after the molten resin is injected into the cavity 53 from the gate 25, the molten resin radially flows inside the cavity 53, and the molten resin simultaneously reaches the first cavity part 57 and parts at which the plurality of nozzle holes 6 are formed (cavity parts that surround the plurality of nozzle hole forming pins 54). After the molten resin is filled in the cavity parts that surround the plurality of nozzle hole forming pins 54, the molten resin concentrically equally flows toward an outward end in a radial direction of the first cavity part 57, and thereafter, the molten resin is filled in the second cavity part 58. Moreover, the mold 50 according to the embodiment can form shapes of the nozzle holes 6 and their peripheries with a high degree of accuracy since the cavity parts that form the nozzle holes 6 are positioned near the gate 25 and injection pressure and keeping pressure are equally and surely added to the cavity parts that form the nozzle holes 6. The injection molding of the nozzle plate 3 by the mold 50 according to the embodiment can improve a production efficiency of the nozzle plate 3 to ensure cost reduction of the nozzle plate 3, compare with a case that performs a cutting work to the nozzle plate 3. At the nozzle plate 3 after the injection molding, the separation mark (gate mark) 25*a* of the gate 25 is formed at the center of the plate body portion 8 (a position equidistant from the centers of the respective nozzle holes 6) (see FIGS. 2A to 2B).

The nozzle plate 3 according to the embodiment having the above-described configuration can reduce variation of the spray generated by injection of the fuel from the nozzle hole 6 (variation of grain diameters of fuel microparticles in spraying and variation of concentrations of the fuel microparticles) to ensure homogeneous and fine spray since identical amounts of fuel flowed into the swirl chamber 13 from the first and second fuel guide channels 18 and 20 are simultaneously introduced into the nozzle holes 6 while being swirled in the identical direction inside the swirl chamber 13.

According to the nozzle plate 3 according to the embodiment, the fuel introduced into the inside of the swirl chamber 13 by the first and second fuel guide channels 18 and 20 is flowed and narrowed down in the directions (the identical swirling directions) along the sidewalls 35 and 38 of the swirl chamber 13 by the parts positioned in the swirl chamber 13 (the first and second in-swirl-chamber fuel guide channel portions 47 and 48) among the first and second fuel guide channels 18 and 20 to increase a flow rate. Furthermore, in the swirl chamber 13, the fuel from the first fuel guide channel 18 and the fuel from the second fuel guide channel 20 act on one another when swirling in the identical direction to increase the swirling velocity and a swirling force. Accordingly, the nozzle plate 3 according to the embodiment, compare with a nozzle plate where first and second fuel guide channels 18 and 20 are not disposed to extend to an inside of a swirl chamber 13 and a nozzle plate of a conventional example, can reduce variation of spray generated by injection of the fuel from the nozzle hole 6 since a velocity component increases in the swirling direction of the fuel that passes through the nozzle hole 6 and the fuel injected from the nozzle hole 6 is formed into thin films, thus ensuring further fine and homogeneous spray.

For the shapes of the first and second in-swirl-chamber fuel guide channel portions 47 and 48 according to the embodiment (the shapes having the channels with a constant depth and the channel widths that gradually reduce along the flow of a fluid), their processing is very difficult when forming them by machining a metallic plate. In contrast, when forming them as a mold of an injection molded product, the processing becomes easy and a degree of freedom of the shape increases.

Modification 1

Figure 5C:
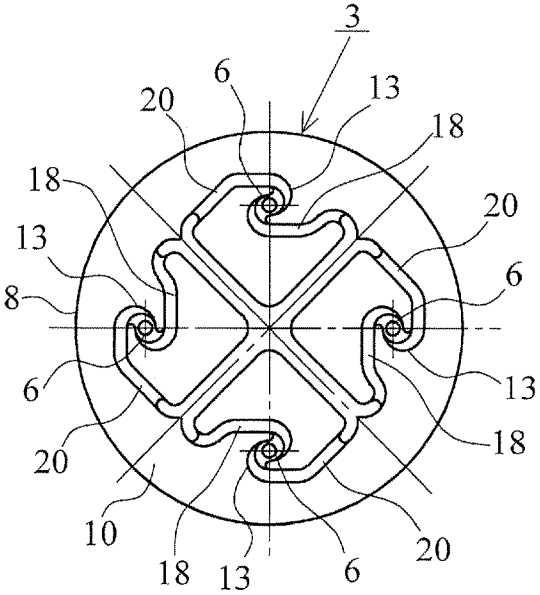
Figure 5B:
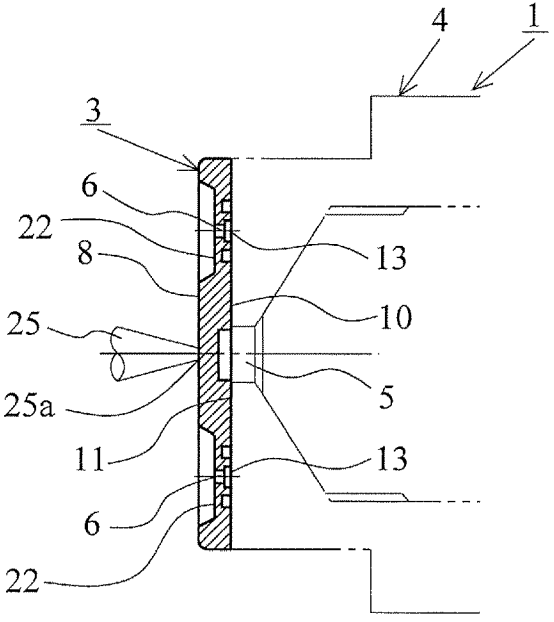
Figure 5A:
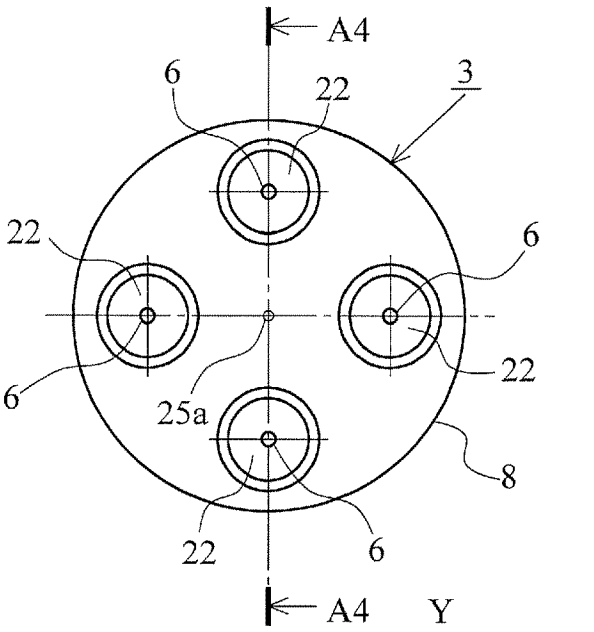

FIG. 5 are views showing a nozzle plate 3 according to the modification. FIG. 5A is a plan view of the nozzle plate 3, FIG. 5B is a cross-sectional view of the nozzle plate 3 taken along a line A4-A4 in FIG. 5A, and FIG. 5C is a back surface view of the nozzle plate 3.

As shown in FIG. 5, the nozzle plate 3 according to the modification has a shape where the circular cylindrical fitted portion 7 of the nozzle plate 3 according to the first embodiment is omitted, and is constituted of only a part corresponding to the plate body portion 8 of the nozzle plate 3 according to the first embodiment. Other configuration of the nozzle plate 3 according to the modification is similar to that of the nozzle plate 3 according to the first embodiment. That is, at the nozzle plate 3 according to the modification, configurations of the nozzle hole 6, the swirl chamber 13, and the first and second fuel guide channels 18 and 20 are similar to those of the nozzle plate 3 according to the first embodiment. The nozzle plate 3 according to the modification, similarly to the nozzle plate 3 according to the first embodiment, is fixed to the valve body 4 in a state where the inner surface 10 of the plate body portion 8 is brought into contact with the distal end surface 11 of the valve body 4. Such nozzle plate 3 according to the modification can obtain an effect similar to that of the nozzle plate 3 according to the first embodiment. The nozzle plate 3 has an outer shape deformed as necessary corresponding to a shape at a distal end side of the valve body 4.

Figure 6:
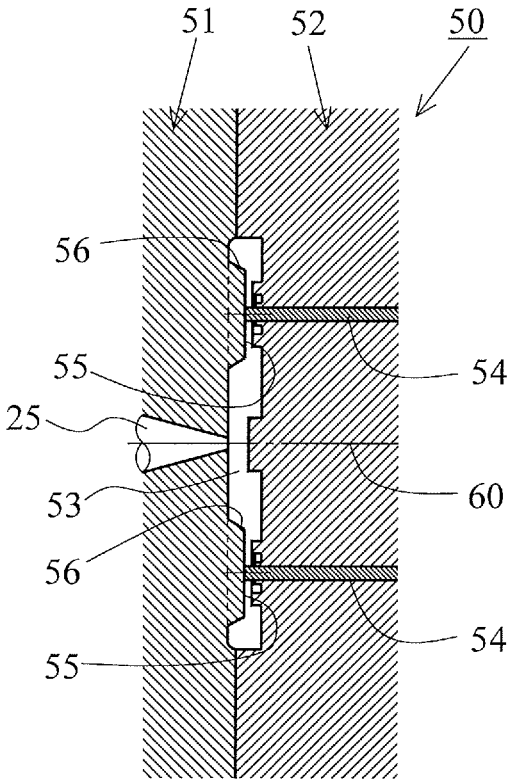
FIG. 6 is a cross-sectional view of a mold for injection molding of the nozzle plate according to the modification 1 of the first embodiment of the present invention.

FIG. 6 is a view showing a mold structure for injection molding of the nozzle plate 3 according to the modification. The mold 50 shown in FIG. 6 has the cavity 53 formed between the first mold 51 and the second mold 52, and the nozzle hole forming pins 54 for forming the nozzle holes 6. The nozzle hole forming pins 54 project inside the cavity 53. The nozzle hole forming pin 54 has a distal end bumped against the cavity inner surface 55 of the first mold 51. The first mold 51 has positions against which the nozzle hole forming pins 54 are bumped. These positions are the convex portions 56 for forming the bottomed recesses 22. The cavity 53 has a shape where the second cavity part 58 at the cavity 53 of the mold according to first embodiment is omitted, and approximately corresponds to the first cavity part 57 at the cavity 53 of the mold 50 according to first embodiment. Then, the gate 25, which injects a molten resin into the cavity 53, opens into a center of the cavity 53. A center of an opening portion of the gate 25 is positioned on the central axis 60 of the cavity 53, and positioned equidistant from centers of the plurality of nozzle holes 6 (centers of the nozzle hole forming pins 54) (see FIGS. 5A to 5B).

In such mold 50, after the molten resin is injected into the cavity 53 from the gate 25, the molten resin radially flows inside the cavity 53, and the molten resin simultaneously reaches parts at which the plurality of nozzle holes 6 are formed inside the cavity 53 (cavity parts that surround the plurality of nozzle hole forming pins 54). After the molten resin is filled in the cavity parts that surround the plurality of nozzle hole forming pins 54, the molten resin concentrically equally flows toward an outward end in a radial direction of the cavity 53, and then, the molten resin is filled in the entire cavity 53. Moreover, the mold 50 according to the embodiment can form shapes of the nozzle holes 6 and their peripheries with a high degree of accuracy since the cavity parts that form the nozzle holes 6 are positioned near the gate 25 and the injection pressure and the keeping pressure are equally and surely added to the cavity parts that form the nozzle holes 6. The injection molding of the nozzle plate 3 by the mold 50 according to the embodiment can improve a production efficiency of the nozzle plate 3 to ensure cost reduction of the nozzle plate 3, compare with a case that performs a cutting work to the nozzle plate 3. At the nozzle plate 3 after the injection molding, the separation mark (gate mark) 25*a* of the gate 25 is formed at a position equidistant from the centers of the respective nozzle holes 6.

Modification 2

Figure 7A:
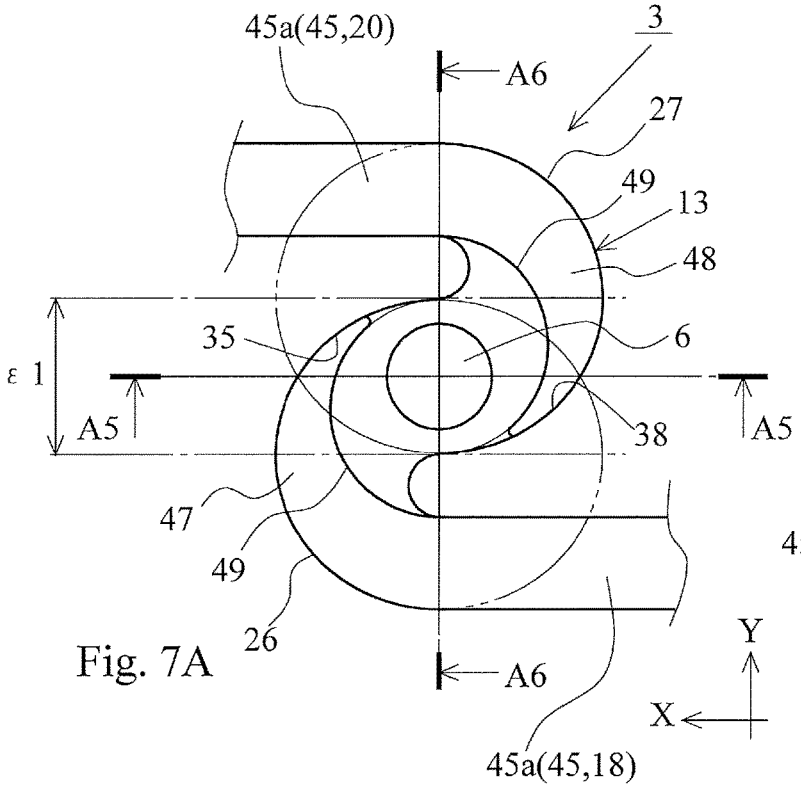
Figure 7C:
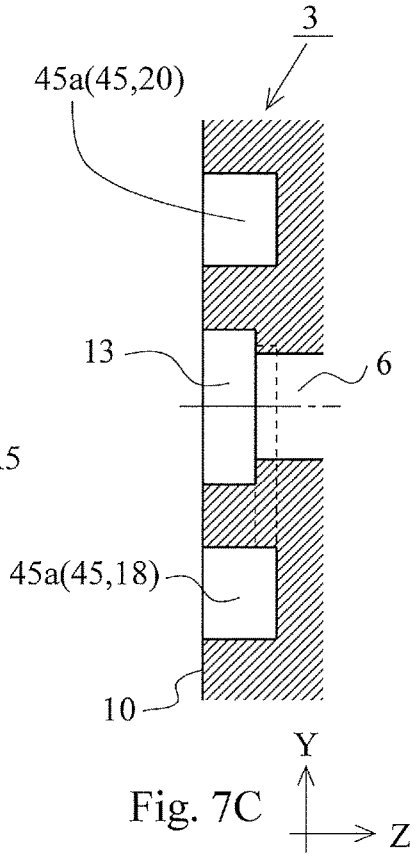
Figure 7B:
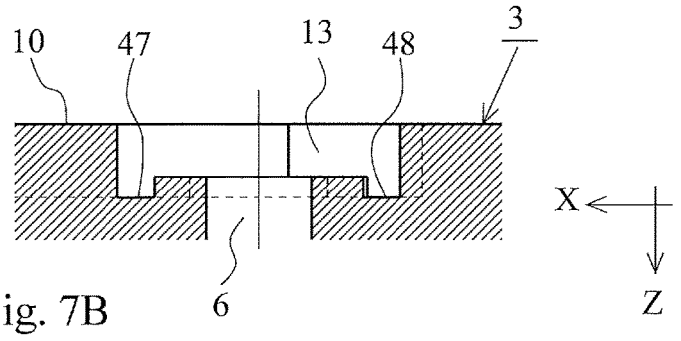

FIGS. 7A-7C are detailed views of a swirl chamber 13 of a nozzle plate 3 according to a modification, and correspond to FIG. 3. FIG. 7A is a plan view of the swirl chamber 13, FIG. 7B is a cross-sectional view of the swirl chamber 13 taken along a line A5-A5 in FIG. 7A, and FIG. 7C is a cross-sectional view of the swirl chamber 13 taken along a line A6-A6 in FIG. 7A.

As shown in FIGS. 7A-7C, the nozzle plate 3 according to the modification is similar to the nozzle plate 3 according to the first embodiment, except that distal ends of the first and second in-swirl-chamber fuel guide channel portions 47 and 48 are rounded into arc shapes (a first difference) and that lengths of the first and second in-swirl-chamber fuel guide channel portions 47 and 48 are shorter than the lengths of the first and second in-swirl-chamber fuel guide channel portions 47 and 48 of the nozzle plate 3 according to the first embodiment (a second difference). The nozzle plate 3 according to this modification can achieve an effect similar to that of the nozzle plate 3 according to the first embodiment. The first in-swirl-chamber fuel guide channel portion 47 is preferred to extend as approached to a position where an interval between the sidewall 35 of the first elliptical-shaped recessed portion 26 and the nozzle hole 6 becomes narrowest as much as possible. The second in-swirl-chamber fuel guide channel portion 48 is preferred to extend as approached to a position where an interval between the sidewall 38 of the second elliptical-shaped recessed portion 27 and the nozzle hole 6 becomes narrowest as much as possible.

Second Embodiment

Figure 8A:
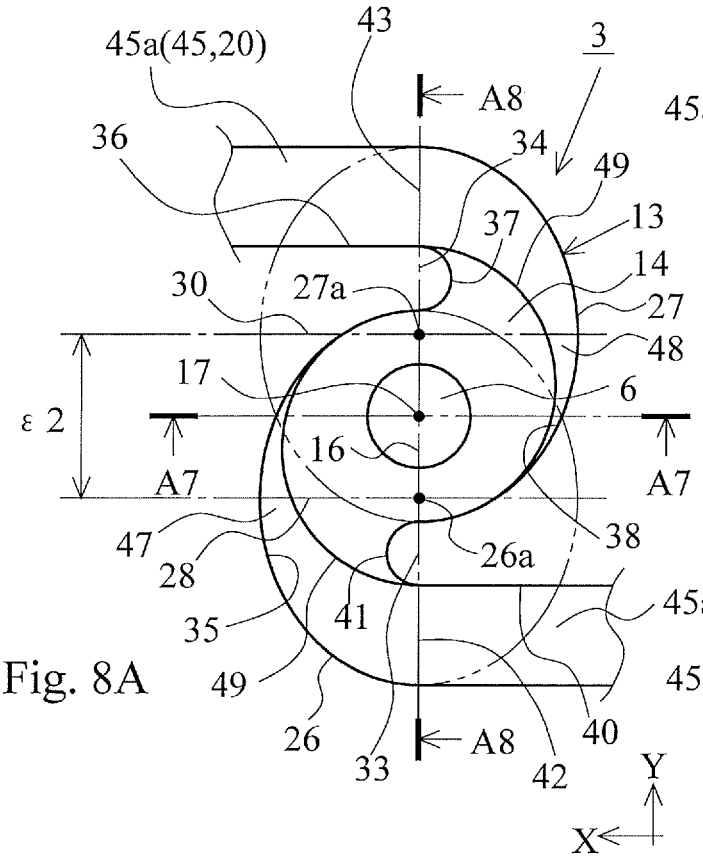
Figure 8C:
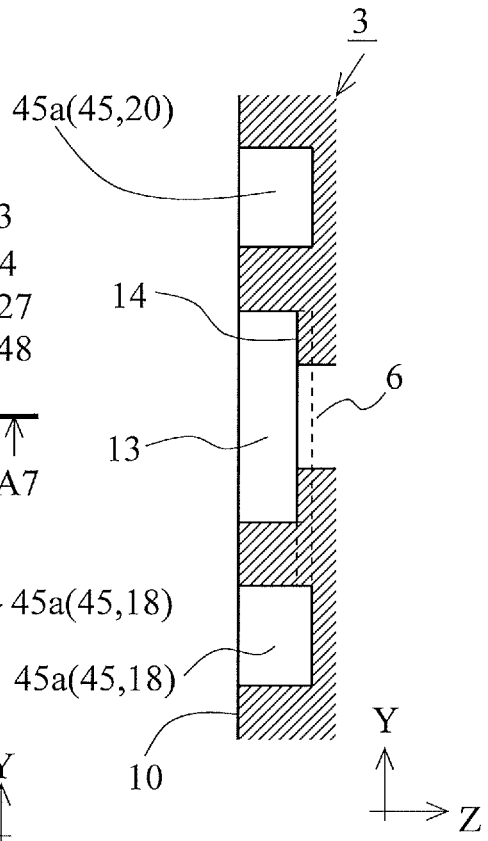
Figure 8B:
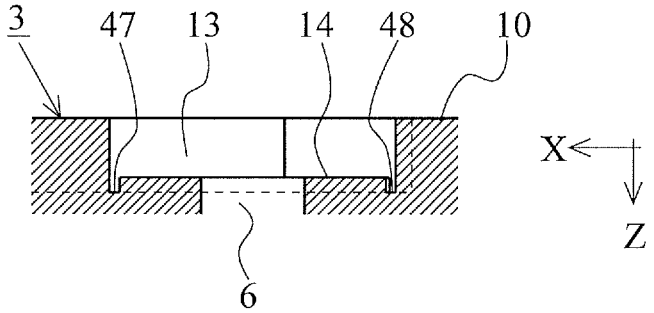

FIG. 8 are detailed views of a swirl chamber 13 of a nozzle plate 3 according to a second embodiment of the present invention, and correspond to FIG. 3. FIG. 8A is a plan view of the swirl chamber 13, FIG. 8B is a cross-sectional view of the swirl chamber 13 taken along a line A7-A7 in FIG. 8A, and FIG. 8C is a cross-sectional view of the swirl chamber 13 taken along a line A8-A8 in FIG. 8A.

As shown in FIG. 8, the swirl chamber 13 according to the embodiment is different from the swirl chamber 13 according to the first embodiment where the short axes of the first and second elliptical-shaped recessed portions are disposed along a Y-axis direction, in that being formed such that long axes of first and second elliptical-shaped recessed portions are disposed along the Y-axis direction, and the long axis of the second elliptical-shaped recessed portion is positioned on an extension of the long axis of the first elliptical-shaped recessed portion. In the following explanation of the swirl chamber 13 according to the embodiment, the explanation which overlaps with the explanation of the swirl chamber 13 according to the first embodiment is omitted as necessary.

As shown in FIG. 8, the swirl chamber 13 has a shape as formed by combining the first elliptical-shaped recessed portion 26, which is a recess formed at the inner surface 10 side of the plate body portion 8 (at a side of a surface opposed to the fuel injection port 5), with the second elliptical-shaped recessed portion 27, which is a recess that has a size identical to a size of the first elliptical-shaped recessed portion 26 (has an identical planar shape and an identical depth from the inner surface 10). Then, the long axis 34 of the second elliptical-shaped recessed portion 27 is disposed on an extended line of the long axis 33 of the first elliptical-shaped recessed portion 26, and the center 27*a* (an intersection point of the short axis 30 and the long axis 34) of the second elliptical-shaped recessed portion 27 is disposed displaced from the center 26*a* (an intersection point of the short axis 28 and the long axis 33) of the first elliptical-shaped recessed portion 26 by a predetermined dimension (ε2). Then, at this swirl chamber 13, the first elliptical-shaped recessed portion 26 partially overlaps with the second elliptical-shaped recessed portion 27, the first fuel guide channel 18 opens at an end portion side of the long axis 33 of the first elliptical-shaped recessed portion 26 and at an end portion side of the long axis 33 of the first elliptical-shaped recessed portion 26 that does not overlap with the second elliptical-shaped recessed portion 27, and the second fuel guide channel 20 opens at an end portion side of the long axis 34 of the second elliptical-shaped recessed portion 27 and at an end portion side of the long axis 34 of the second elliptical-shaped recessed portion 27 that does not overlap with the first elliptical-shaped recessed portion 26. At elliptical shapes when the first and second elliptical-shaped recessed portions 26 and 27 are viewed in plan view, one main axes are the long axes 33 and 34, and other main axes are the short axes 28 and 30.

As shown in FIG. 8, the first elliptical-shaped recessed portion 26 of the swirl chamber 13 has the sidewall 35 coupled to the channel sidewall 36 of the second fuel guide channel 20 near the first elliptical-shaped recessed portion 26 by the smooth curved surface 37 (a curved surface whose shape in plan view is a semicircle that is convex inward the swirl chamber 13). This curved surface 37 is coupled to the sidewall 35 of the first elliptical-shaped recessed portion 26 on the long axis 34 of the second elliptical-shaped recessed portion 27, and is coupled to the channel sidewall 36 of the second fuel guide channel 20 near the first elliptical-shaped recessed portion 26 on the long axis 34 of the second elliptical-shaped recessed portion 27. The second elliptical-shaped recessed portion 27 of the swirl chamber 13 has the sidewall 38 coupled to the channel sidewall 40 of the first fuel guide channel 18 near the second elliptical-shaped recessed portion 27 by the smooth curved surface 41 (a curved surface whose shape in plan view is a semicircle that is convex inward the swirl chamber 13). This curved surface 41 is coupled to the sidewall 38 of the second elliptical-shaped recessed portion 27 on the long axis 33 of the first elliptical-shaped recessed portion 26, and is coupled to the channel sidewall 40 of the first fuel guide channel 18 near the second elliptical-shaped recessed portion 27 on the long axis 33 of the first elliptical-shaped recessed portion 26. Accordingly, the first fuel guide channel 18 has the opening portion (coupling portion) 42 into the swirl chamber 13. The opening portion 42 is on the long axis 33 of the first elliptical-shaped recessed portion 26. The second fuel guide channel 20 has the opening portion (coupling portion) 43 into the swirl chamber 13. The opening portion 43 is on the long axis 34 of the second elliptical-shaped recessed portion 27. Then, when the inner surface 10 of the plate body portion 8 is viewed in plan view, the nozzle hole 6 is formed as positioned at the middle 17 of the imaginary straight line 16 that couples the center 26*a* of the first elliptical-shaped recessed portion 26 to the center 27*a* of the second elliptical-shaped recessed portion 27 (formed at a position that bisects the imaginary straight line 16). When the swirl chamber 13 is viewed in plan view, the opening portion 42 of the first fuel guide channel 18 into the first elliptical-shaped recessed portion 26 (the swirl chamber 13) and the opening portion 43 of the second fuel guide channel 20 into the second elliptical-shaped recessed portion 27 (the swirl chamber 13) are positioned to have a dyad symmetry with respect to the middle 17 of the imaginary straight line 16. Intervals between the sidewalls 35 and 38 of the swirl chamber 13 and the nozzle hole 6 are formed to become narrowest (smallest) on the long axes 33 and 34 of the first and second elliptical-shaped recessed portions 26 and 27 (a coupling portion of the sidewall 35 to the curved surface 37, and a coupling portion of the sidewall 38 to the curved surface 41). As a result, a flow of the fuel that performs the swirling movement inside the first elliptical-shaped recessed portion 26 and a flow of the fuel that performs the swirling movement inside the second elliptical-shaped recessed portion 27 act on one another to increase a swirling velocity of the fuel inside the swirl chamber 13.

As shown in FIG. 8, the first and second fuel guide channels 18 and 20 have the swirl-chamber-side coupling portions 45*a* that open into the swirl chamber 13 as being perpendicular to the long axes 33 and 34 of the swirl chamber 13. Then, the first and second fuel guide channels 18 and 20 are disposed to extend to an inside of the swirl chamber 13 from the opening portions 42 and 43 into the swirl chamber 13. That is, the first fuel guide channel 18 includes the part (the first in-swirl-chamber fuel guide channel portion) 47 disposed to extend while gradually reducing the channel width (channel cross-sectional area) from the opening portion 42 into the first elliptical-shaped recessed portion 26 to an inside of the first elliptical-shaped recessed portion 26 (from one end to another end of the long axis 33 of the first elliptical-shaped recessed portion 26) along the sidewall 35 of the first elliptical-shaped recessed portion 26. The second fuel guide channel 20 includes the part (the second in-swirl-chamber fuel guide channel portion) 48 disposed to extend while gradually reducing the channel width (channel cross-sectional area) from the opening portion 43 into the second elliptical-shaped recessed portion 27 to an inside of the second elliptical-shaped recessed portion 27 (from one end to another end of the long axis 34 of the second elliptical-shaped recessed portion 27) along the sidewall 38 of the second elliptical-shaped recessed portion 27. When these first in-swirl-chamber fuel guide channel portion 47 and second in-swirl-chamber fuel guide channel portion 48 are viewed in plan view, the internal surfaces 49 at a side of the nozzle hole 6 have smooth arc shapes (arc shapes that are convex in directions identical to the sidewalls 35 and 38, and for example, in a case of a true circle, a circular arc that is a part of the true circle, and in a case of an ellipse, an elliptical arc that is a part of the ellipse). Then, when the swirl chamber 13 is viewed in plan view, the first in-swirl-chamber fuel guide channel portion 47 and the second in-swirl-chamber fuel guide channel portion 48 are formed to have a dyad symmetry with respect to the middle 17 of the imaginary straight line 16. Such first and second in-swirl-chamber fuel guide channel portions 47 and 48 improve the flow in a tangential direction of the nozzle hole 6, of the fuel supplied into the swirl chamber 13 from the first fuel guide channel portions 45, 45 to reduce the flow in a normal direction toward the nozzle hole 6, thus guiding the fuel into the inside of the swirl chamber 13 (parts where the intervals between the sidewalls 35 and 38 of the swirl chamber 13 and the nozzle hole 6 become narrowest) along the sidewalls 35 and 38 of the swirl chamber 13. Then, the flow of the fuel from sides of the first and second in-swirl-chamber fuel guide channel portions 47 and 48 toward the nozzle hole 6 is narrowed down to accelerate by the first and second in-swirl-chamber fuel guide channel portions 47 and 48, which are configured to gradually reduce the channel width, since the first and second in-swirl-chamber fuel guide channel portions 47 and 48 are formed deeper than the swirl chamber 13 (having depths identical to those of the first and second fuel guide channels 18 and 20).

Third Embodiment

Figure 9A:
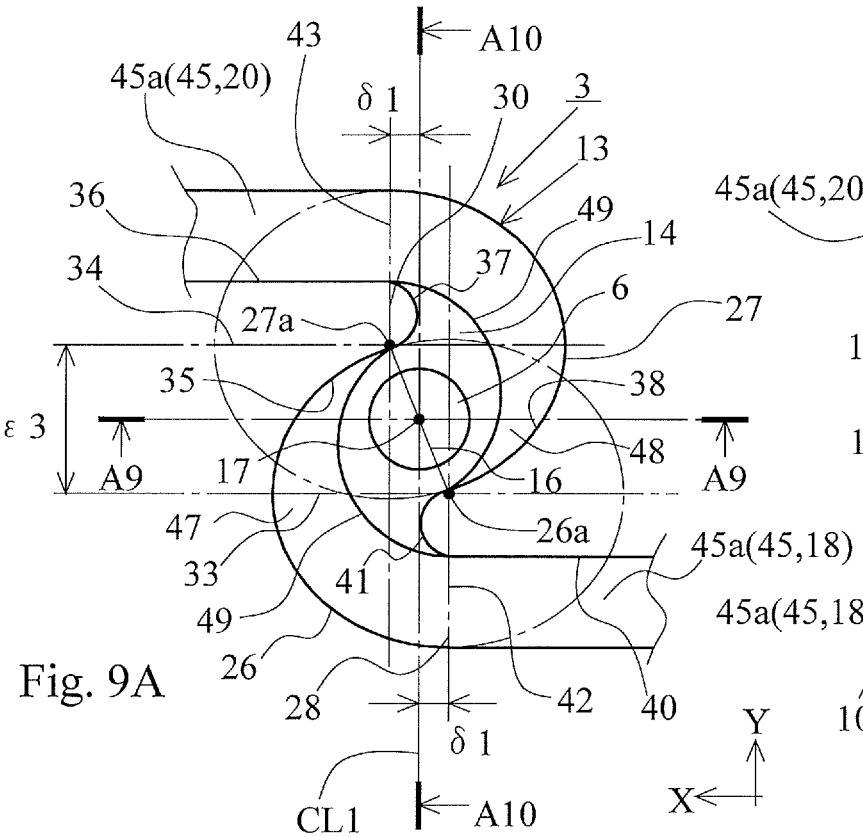
Figure 9C:
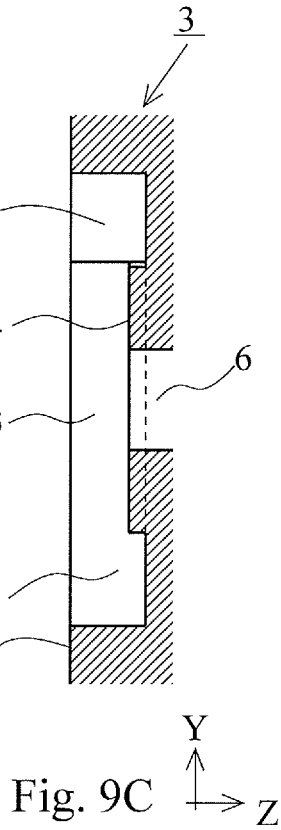
Figure 9B:
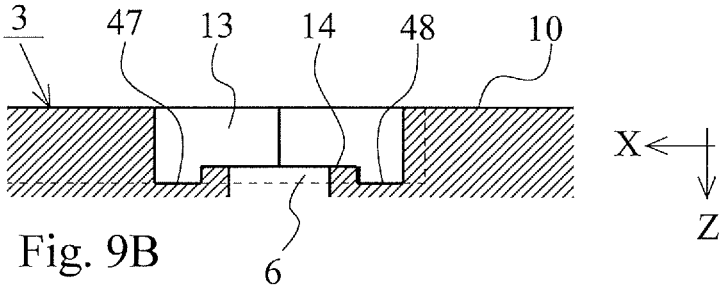

FIG. 9 are detailed views of a swirl chamber 13 of a nozzle plate 3 according to a third embodiment of the present invention, and correspond to FIG. 3. FIG. 9A is a plan view of the swirl chamber 13, FIG. 9B is a cross-sectional view of the swirl chamber 13 taken along a line A9-A9 in FIG. 9A, and FIG. 9C is a cross-sectional view of the swirl chamber 13 taken along a line A10-A10 in FIG. 9A.

As shown in FIG. 9, the swirl chamber 13 according to the embodiment is common to the swirl chamber 13 according to first embodiment, in that the short axes 28 and 30 of the first and second elliptical-shaped recessed portions 26 and 27 are disposed along the Y-axis direction, and that the center 27*a* of the second elliptical-shaped recessed portion 27 is disposed separated from the center 26*a* of the first elliptical-shaped recessed portion 26 along the Y-axis direction by a predetermined dimension (ε3), but different from the swirl chamber 13 according to the first embodiment, in that the center 26*a* of the first elliptical-shaped recessed portion 26 is disposed separated from a center line CL1, which passes through a center of the nozzle hole 6 and is parallel to the Y-axis, in a right direction in the view by a predetermined dimension (δ1), and that the center 27*a* of the second elliptical-shaped recessed portion 27 is disposed separated from the center line CL1, which passes through the center of the nozzle hole 6 and is parallel to the Y-axis, in a left direction in the view by the predetermined dimension (δ1). In the following explanation of the swirl chamber 13 according to the embodiment, the explanation which overlaps with the explanation of the swirl chamber 13 according to the first embodiment is omitted as necessary.

As shown in FIG. 9, the swirl chamber 13 has a shape as formed by combining the first elliptical-shaped recessed portion 26, which is a recess formed at the inner surface 10 side of the plate body portion 8 (at a side of a surface opposed to the fuel injection port 5), with the second elliptical-shaped recessed portion 27, which is a recess that has a size identical to a size of the first elliptical-shaped recessed portion 26 (has an identical planar shape and an identical depth from the inner surface 10). Then, the second elliptical-shaped recessed portion 27 has the center 27*a* disposed separated from the center 26*a* of the first elliptical-shaped recessed portion 26 in a direction along the Y-axis by the predetermined dimension (ε3). While the short axis 28 of the first elliptical-shaped recessed portion 26 and the short axis 30 of the second elliptical-shaped recessed portion are both disposed in the direction along the Y-axis, they are disposed as positioned separating in a direction along the X-axis. That is, the center 26*a* of the first elliptical-shaped recessed portion 26 is positioned separated from the center line CL1 in the right direction in the view by the predetermined dimension (δ1). The center 27*a* of the second elliptical-shaped recessed portion 27 is positioned separated from the center line CL1 in the left direction in the view by the predetermined dimension (δ1). When the inner surface 10 of the plate body portion 8 is viewed in plan view, the nozzle hole 6 is formed as positioned at the middle 17 of the imaginary straight line 16 that couples the center 26*a* of the first elliptical-shaped recessed portion 26 to the center 27*a* of the second elliptical-shaped recessed portion 27 (formed at a position that bisects the imaginary straight line 16). Then, at this swirl chamber 13, the first elliptical-shaped recessed portion 26 partially overlaps with the second elliptical-shaped recessed portion 27, the first fuel guide channel 18 opens at an end portion side of the short axis 28 of the first elliptical-shaped recessed portion 26 and at an end portion side of the short axis 28 of the first elliptical-shaped recessed portion 26 that does not overlap with the second elliptical-shaped recessed portion 27, and the second fuel guide channel 20 opens at an end portion side of the short axis 30 of the second elliptical-shaped recessed portion 27 and at an end portion side of the short axis 30 of the second elliptical-shaped recessed portion 27 that does not overlap with the first elliptical-shaped recessed portion 26. At elliptical shapes when the first and second elliptical-shaped recessed portions 26 and 27 are viewed in plan view, one main axes are the short axes 28 and 30, and other main axes are the long axes 33 and 34.

As shown in FIG. 9, the first elliptical-shaped recessed portion 26 of the swirl chamber 13 has the sidewall 35 coupled to the channel sidewall 36 of the second fuel guide channel 20 near the first elliptical-shaped recessed portion 26 by the smooth curved surface 37 (a curved surface whose shape in plan view is a semicircle that is convex inward the swirl chamber 13). This curved surface 37 is coupled to the sidewall 35 of the first elliptical-shaped recessed portion 26 on the short axis 30 of the second elliptical-shaped recessed portion 27, and is coupled to the channel sidewall 36 of the second fuel guide channel 20 near the first elliptical-shaped recessed portion 26 on the short axis 30 of the second elliptical-shaped recessed portion 27. The second elliptical-shaped recessed portion 27 of the swirl chamber 13 has the sidewall 38 coupled to the channel sidewall 40 of the first fuel guide channel 18 near the second elliptical-shaped recessed portion 27 by the smooth curved surface 41 (a curved surface whose shape in plan view is a semicircle that is convex inward the swirl chamber 13). This curved surface 41 is coupled to the sidewall 38 of the second elliptical-shaped recessed portion 27 on the short axis 28 of the first elliptical-shaped recessed portion 26, and is coupled to the channel sidewall 40 of the first fuel guide channel 18 near the second elliptical-shaped recessed portion 27 on the short axis 28 of the first elliptical-shaped recessed portion 26. Accordingly, the first fuel guide channel 18 has the opening portion (coupling portion) 42 into the swirl chamber 13. The opening portion 42 is on the short axis 28 of the first elliptical-shaped recessed portion 26. The second fuel guide channel 20 has the opening portion (coupling portion) 43 into the swirl chamber 13. The opening portion 43 is on the short axis 30 of the second elliptical-shaped recessed portion 27. Then, when the swirl chamber 13 is viewed in plan view, the opening portion 42 of the first fuel guide channel 18 into the first elliptical-shaped recessed portion 26 (the swirl chamber 13) and the opening portion 43 of the second fuel guide channel 20 into the second elliptical-shaped recessed portion 27 (the swirl chamber 13) are positioned to have a dyad symmetry with respect to the middle 17 of the imaginary straight line 16. Intervals between the sidewalls 35 and 38 of the swirl chamber 13 and the nozzle hole 6 are formed to become narrowest (smallest) near a coupling portion of the sidewall 35 to the curved surface 37, and near a coupling portion of the sidewall 38 to the curved surface 41. As a result, a flow of the fuel that performs the swirling movement inside the first elliptical-shaped recessed portion 26 and a flow of the fuel that performs the swirling movement inside the second elliptical-shaped recessed portion 27 act on one another to increase a swirling velocity of the fuel inside the swirl chamber 13.

As shown in FIG. 9, the first and second fuel guide channels 18 and 20 have the swirl-chamber-side coupling portions 45*a* that open into the swirl chamber 13 as being perpendicular to the short axes 28 and 30 of the swirl chamber 13. Then, the first and second fuel guide channels 18 and 20 are disposed to extend to an inside of the swirl chamber 13 from the opening portions 42 and 43 into the swirl chamber 13. That is, the first fuel guide channel 18 includes the part (the first in-swirl-chamber fuel guide channel portion) 47 disposed to extend while gradually reducing the channel width (channel cross-sectional area)

from the opening portion 42 into the first elliptical-shaped recessed portion 26 to an inside of the first elliptical-shaped recessed portion 26 (from one end of the short axis 28 of the first elliptical-shaped recessed portion 26 to the coupling portion of the sidewall 35 of the first elliptical-shaped recessed portion 26 to the curved surface 37) along the sidewall 35 of the first elliptical-shaped recessed portion 26. The second fuel guide channel 20 includes the part (the second in-swirl-chamber fuel guide channel portion) 48 disposed to extend while gradually reducing the channel width (channel cross-sectional area) from the opening portion 43 into the second elliptical-shaped recessed portion 27 to an inside of the second elliptical-shaped recessed portion 27 (from one end of the short axis 30 of the second elliptical-shaped recessed portion 27 to the coupling portion of the sidewall 38 of the second elliptical-shaped recessed portion 27 to the curved surface 41) along the sidewall 38 of the second elliptical-shaped recessed portion 27. When these first in-swirl-chamber fuel guide channel portion 47 and second in-swirl-chamber fuel guide channel portion 48 are viewed in plan view, the internal surfaces 49 at a side of the nozzle hole 6 have smooth arc shapes (arc shapes that are convex in directions identical to the sidewalls 35 and 38, and for example, in a case of a true circle, a circular arc that is a part of the true circle, and in a case of an ellipse, an elliptical arc that is a part of the ellipse). Then, when the swirl chamber 13 is viewed in plan view, the first in-swirl-chamber fuel guide channel portion 47 and the second in-swirl-chamber fuel guide channel portion 48 are formed to have a dyad symmetry with respect to the middle 17 of the imaginary straight line 16. Such first and second in-swirl-chamber fuel guide channel portions 47 and 48 improve the flow in a tangential direction of the nozzle hole 6, of the fuel supplied into the swirl chamber 13 from the first fuel guide channel portions 45, 45 to reduce the flow in a normal direction toward the nozzle hole 6, thus guiding the fuel into the inside of the swirl chamber 13 (parts where the intervals between the sidewalls 35 and 38 of the swirl chamber 13 and the nozzle hole 6 become narrowest) along the sidewalls 35 and 38 of the swirl chamber 13. Then, the flow of the fuel from sides of the first and second in-swirl-chamber fuel guide channel portions 47 and 48 toward the nozzle hole 6 is narrowed down to accelerate by the first and second in-swirl-chamber fuel guide channel portions 47 and 48, which are configured to gradually reduce the channel width, since the first and second in-swirl-chamber fuel guide channel portions 47 and 48 are formed deeper than the swirl chamber 13 (having depths identical to those of the first and second fuel guide channels 18 and 20).

Fourth Embodiment

Figure 10A:
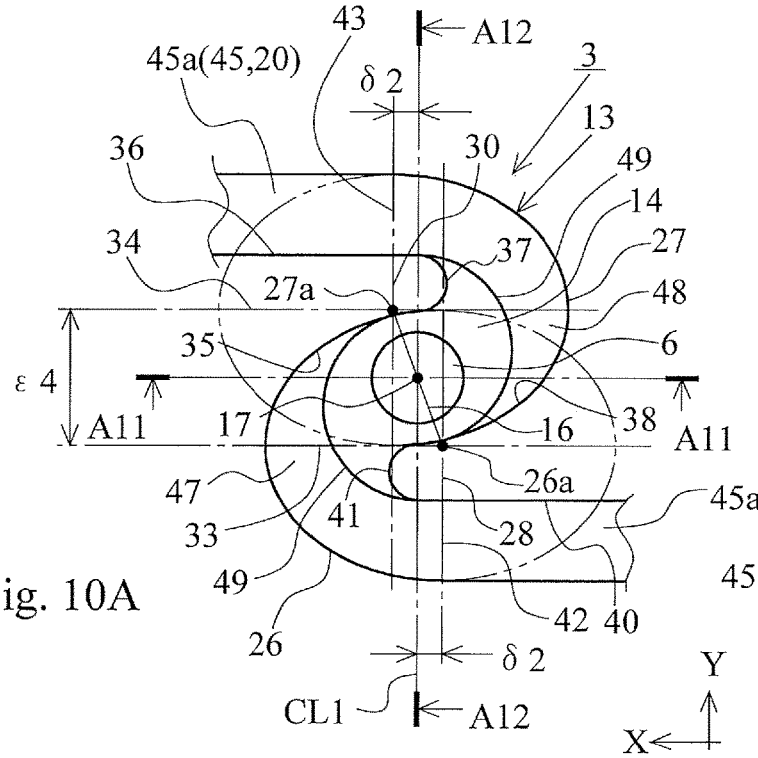
Figure 10C:
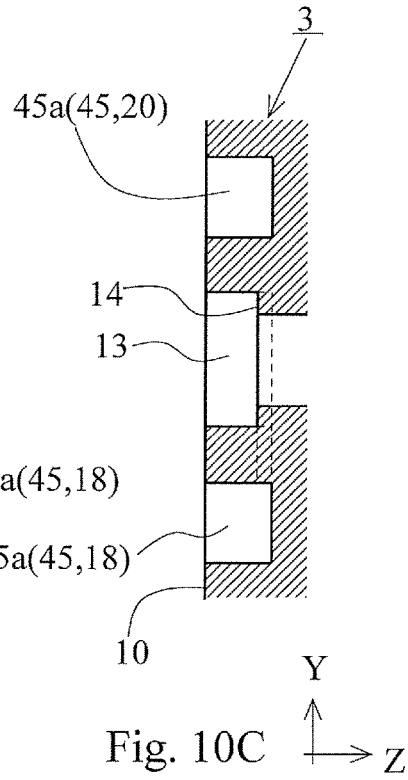
Figure 10B:
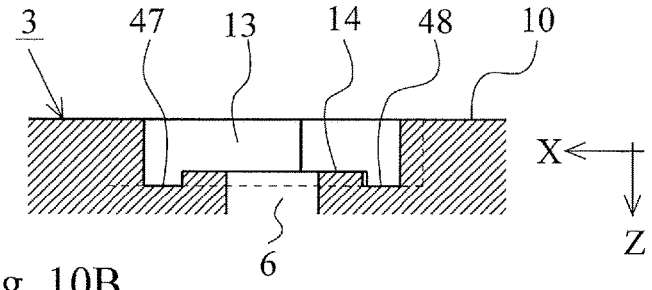

FIG. 10 are detailed views of a swirl chamber 13 of a nozzle plate 3 according to a fourth embodiment of the present invention, and views showing a modification of the nozzle plate 3 according to the third embodiment. FIG. 10A is a plan view of the swirl chamber 13, FIG. 10B is a cross-sectional view of the swirl chamber 13 taken along a line A11-A11 in FIG. 10A, and FIG. 10C is a cross-sectional view of the swirl chamber 13 taken along a line A12-A12 in FIG. 10A.

As shown in FIG. 10, the swirl chamber 13 according to the embodiment is different from the swirl chamber 13 according to the third embodiment, in that being formed such that a coupling part of the sidewall 35 of the first elliptical-shaped recessed portion 26 to the curved surface 37 is positioned on the center line CL1, and a coupling part of the sidewall 38 of the second elliptical-shaped recessed portion 27 to the curved surface 41 is positioned on the center line CL1. In the following explanation of the swirl chamber 13 according to the embodiment, the explanation which overlaps with the explanation of the swirl chambers 13 according to the first and third embodiments is omitted as necessary.

As shown in FIG. 10, the swirl chamber 13 has a shape as formed by combining the first elliptical-shaped recessed portion 26, which is a recess formed at the inner surface 10 side of the plate body portion 8 (at a side of a surface opposed to the fuel injection port 5), with the second elliptical-shaped recessed portion 27, which is a recess that has a size identical to a size of the first elliptical-shaped recessed portion 26 (has an identical planar shape and an identical depth from the inner surface 10). Then, the second elliptical-shaped recessed portion 27 has the center 27*a* disposed separated from the center 26*a* of the first elliptical-shaped recessed portion 26 in the direction along the Y-axis by a predetermined dimension (ε4). The center 26*a* of the first elliptical-shaped recessed portion 26 is positioned separated from the center line CL1 in the right direction in the view by a predetermined dimension (δ2). The center 27*a* of the second elliptical-shaped recessed portion 27 is positioned separated from the center line CL1 in the left direction in the view by the predetermined dimension (δ2). When the inner surface 10 of the plate body portion 8 is viewed in plan view, the nozzle hole 6 is formed as positioned at the middle 17 of the imaginary straight line 16 that couples the center 26*a* of the first elliptical-shaped recessed portion 26 to the center 27*a* of the second elliptical-shaped recessed portion 27 (formed at a position that bisects the imaginary straight line 16). Then, at this swirl chamber 13, the first elliptical-shaped recessed portion 26 partially overlaps with the second elliptical-shaped recessed portion 27, the first fuel guide channel 18 opens at an end portion side of the short axis 28 of the first elliptical-shaped recessed portion 26 and at an end portion side of the short axis 28 of the first elliptical-shaped recessed portion 26 that does not overlap with the second elliptical-shaped recessed portion 27, and the second fuel guide channel 20 opens at an end portion side of the short axis 30 of the second elliptical-shaped recessed portion 27 and at an end portion side of the short axis 30 of the second elliptical-shaped recessed portion 27 that does not overlap with the first elliptical-shaped recessed portion 26. At elliptical shapes when the first and second elliptical-shaped recessed portions 26 and 27 are viewed in plan view, one main axes are the short axes 28 and 30, and other main axes are the long axes 33 and 34.

As shown in FIG. 10, the first elliptical-shaped recessed portion 26 of the swirl chamber 13 has the sidewall 35 coupled to the channel sidewall 36 of the second fuel guide channel 20 near the first elliptical-shaped recessed portion 26 by the smooth curved surface 37 (a curved surface whose shape in plan view is a semicircle that is convex inward the swirl chamber 13). This curved surface 37 is coupled to the sidewall 35 of the first elliptical-shaped recessed portion 26 on the center line CL1, and is coupled to the channel sidewall 36 of the second fuel guide channel 20 near the first elliptical-shaped recessed portion 26 on the center line CL1. The second elliptical-shaped recessed portion 27 of the swirl chamber 13 has the sidewall 38 coupled to the channel sidewall 40 of the first fuel guide channel 18 near the second elliptical-shaped recessed portion 27 by the smooth curved surface 41 (a curved surface whose shape in plan view is a semicircle that is convex inward the swirl chamber 13). This curved surface 41 is coupled to the sidewall 38 of the second elliptical-shaped recessed portion 27 on the center line CL1, and is coupled to the channel sidewall 40 of the first fuel guide channel 18 near the second elliptical-shaped recessed portion 27 on the center line CL1. Then, the first fuel guide channel 18 has the opening portion (coupling portion) 42 into the swirl chamber 13. The opening portion 42 is on the short axis 28 of the first elliptical-shaped recessed portion 26. The second fuel guide channel 20 has the opening portion (coupling portion) 43 into the swirl chamber 13. The opening portion 43 is on the short axis 30 of the second elliptical-shaped recessed portion 27. When the swirl chamber 13 is viewed in plan view, the opening portion 42 of the first fuel guide channel 18 into the first elliptical-shaped recessed portion 26 (the swirl chamber 13) and the opening portion 43 of the second fuel guide channel 20 into the second elliptical-shaped recessed portion 27 (the swirl chamber 13) are positioned to have a dyad symmetry with respect to the middle 17 of the imaginary straight line 16. Intervals between the sidewalls 35 and 38 of the swirl chamber 13 and the nozzle hole 6 are formed to become narrowest (smallest) near a coupling portion of the sidewall 35 to the curved surface 37, and near a coupling portion of the sidewall 38 to the curved surface 41. As a result, a flow of the fuel that performs the swirling movement inside the first elliptical-shaped recessed portion 26 and a flow of the fuel that performs the swirling movement inside the second elliptical-shaped recessed portion 27 act on one another to increase a swirling velocity of the fuel inside the swirl chamber 13.

As shown in FIG. 10, the first and second fuel guide channels 18 and 20 have the swirl-chamber-side coupling portions 45*a* that open into the swirl chamber 13 as being perpendicular to the short axes 28 and 30 of the swirl chamber 13. Then, the first and second fuel guide channels 18 and 20 are disposed to extend to an inside of the swirl chamber 13 from the opening portions 42 and 43 into the swirl chamber 13. That is, the first fuel guide channel 18 includes the part (the first in-swirl-chamber fuel guide channel portion) 47 disposed to extend while gradually reducing the channel width (channel cross-sectional area) from the opening portion 42 into the first elliptical-shaped recessed portion 26 to an inside of the first elliptical-shaped recessed portion 26 (from one end of the short axis 28 of the first elliptical-shaped recessed portion 26 to the coupling portion of the sidewall 35 of the first elliptical-shaped recessed portion 26 to the curved surface 37) along the sidewall 35 of the first elliptical-shaped recessed portion 26. The second fuel guide channel 20 includes the part (the second in-swirl-chamber fuel guide channel portion) 48 disposed to extend while gradually reducing the channel width (channel cross-sectional area) from the opening portion 43 into the second elliptical-shaped recessed portion 27 to an inside of the second elliptical-shaped recessed portion 27 (from one end of the short axis 30 of the second elliptical-shaped recessed portion 27 to the coupling portion of the sidewall 38 of the second elliptical-shaped recessed portion 27 to the curved surface 41) along the sidewall 38 of the second elliptical-shaped recessed portion 27. When these first in-swirl-chamber fuel guide channel portion 47 and second in-swirl-chamber fuel guide channel portion 48 are viewed in plan view, the internal surfaces 49 at a side of the nozzle hole 6 have smooth arc shapes (arc shapes that are convex in directions identical to the sidewalls 35 and 38, and for example, in a case of a true circle, a circular arc that is a part of the true circle, and in a case of an ellipse, an elliptical arc that is a part of the ellipse). Then, when the swirl chamber 13 is viewed in plan view, the first in-swirl-chamber fuel guide channel portion 47 and the second in-swirl-chamber fuel guide channel portion 48 are formed to have a dyad symmetry with respect to the middle 17 of the imaginary straight line 16. Such first and second in-swirl-chamber fuel guide channel portions 47 and 48 improve the flow in a tangential direction of the nozzle hole 6, of the fuel supplied into the swirl chamber 13 from the first fuel guide channel portions 45, 45 to reduce the flow in a normal direction toward the nozzle hole 6, thus guiding the fuel into the inside of the swirl chamber 13 (parts where the intervals between the sidewalls 35 and 38 of the swirl chamber 13 and the nozzle hole 6 become narrowest) along the sidewalls 35 and 38 of the swirl chamber 13. Then, the flow of the fuel from sides of the first and second in-swirl-chamber fuel guide channel portions 47 and 48 toward the nozzle hole 6 is narrowed down to accelerate by the first and second in-swirl-chamber fuel guide channel portions 47 and 48, which are configured to gradually reduce the channel width, since the first and second in-swirl-chamber fuel guide channel portions 47 and 48 are formed deeper than the swirl chamber 13 (having depths identical to those of the first and second fuel guide channels 18 and 20).

At the swirl chamber 13 according to the embodiment, compare with the swirl chamber 13 according to the third embodiment, the coupling portion of the sidewall 35 of the first elliptical-shaped recessed portion 26 to the curved surface 37 is positioned near the short axis 28 of the first elliptical-shaped recessed portion 26, and the coupling portion of the sidewall 38 of the second elliptical-shaped recessed portion 27 to the curved surface 41 is positioned near the short axis 30 of the second elliptical-shaped recessed portion 27. As a result, the swirl chamber 13 according to the embodiment, compare with the swirl chamber 13 according to the third embodiment, can guide the fuel to deep into the swirl chamber 13 by the first and second in-swirl-chamber fuel guide channel portions 47 and 48.

Fifth Embodiment

Figure 11A:
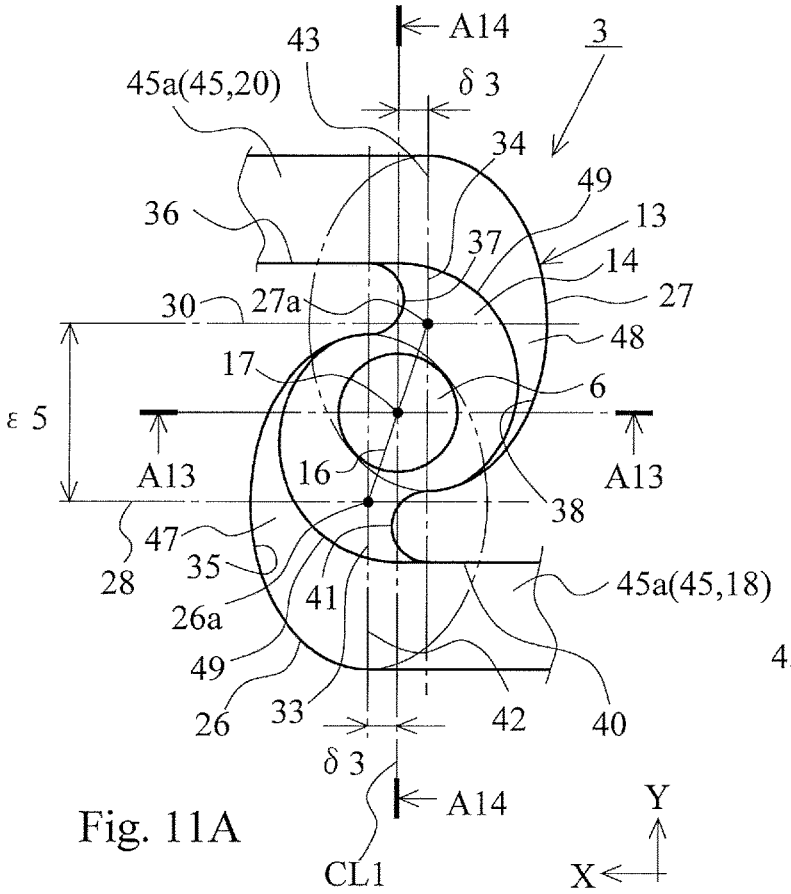
Figure 11C:
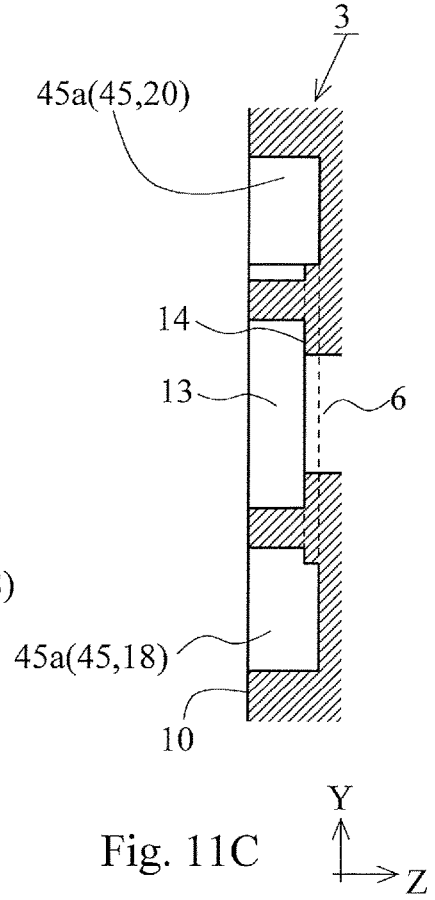
Figure 11B:
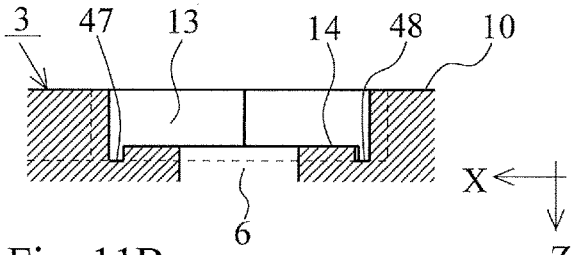

FIG. 11 are detailed views of a swirl chamber 13 of a nozzle plate 3 according to a fifth embodiment of the present invention, and views showing a modification of the swirl chamber 13 according to the second embodiment. FIG. 11A is a plan view of the swirl chamber 13, FIG. 11B is a cross-sectional view of the swirl chamber 13 taken along a line A13-A13 in FIG. 11A, and FIG. 11C is a cross-sectional view of the swirl chamber 13 taken along a line A14-A14 in FIG. 11A.

As shown in FIG. 11, the swirl chamber 13 according to the embodiment is common to the swirl chamber 13 according to the second embodiment, in that the long axes 33 and 34 of the first and second elliptical-shaped recessed portions 26 and 27 are disposed along the Y-axis direction, and that the center 27*a* of the second elliptical-shaped recessed portion 27 is disposed separated from the center 26*a* of the first elliptical-shaped recessed portion 26 along the Y-axis direction by a predetermined dimension (ε5), but different from the swirl chamber 13 according to the second embodiment, in that the center 26*a* of the first elliptical-shaped recessed portion 26 is disposed separated from the center line CL1, which passes through a center of the nozzle hole 6 and is parallel to the Y-axis, in the left direction in the view by a predetermined dimension (δ3), and that the center 27*a* of the second elliptical-shaped recessed portion 27 is disposed separated from the center line CL1 in the right direction in the view by the predetermined dimension (δ3). In the following explanation of the swirl chamber 13 according to the embodiment, the explanation which overlaps with the explanation of the swirl chambers 13 according to the first and second embodiments is omitted as necessary.

As shown in FIG. 11, the swirl chamber 13 has a shape as formed by combining the first elliptical-shaped recessed portion 26, which is a recess formed at the inner surface 10 side of the plate body portion 8 (at a side of a surface opposed to the fuel injection port 5), with the second elliptical-shaped recessed portion 27, which is a recess that has a size identical to a size of the first elliptical-shaped recessed portion 26 (has an identical planar shape and an identical depth from the inner surface 10). Then, the second elliptical-shaped recessed portion 27 has the center 27*a* disposed separated from the center 26*a* of the first elliptical-shaped recessed portion 26 in the direction along the Y-axis by the predetermined dimension (ε5). While the long axis 33 of the first elliptical-shaped recessed portion 26 and the long axis 34 of the second elliptical-shaped recessed portion are both disposed in the direction along the Y-axis, they are disposed as positioned separating in the direction along the X-axis. That is, the center 26*a* of the first elliptical-shaped recessed portion 26 is positioned separated from the center line CL1 in the left direction in the view by the predetermined dimension (δ3). The center 27*a* of the second elliptical-shaped recessed portion 27 is positioned separated from the center line CL1 in the right direction in the view by the predetermined dimension (δ3). When the inner surface 10 of the plate body portion 8 is viewed in plan view, the nozzle hole 6 is formed as positioned at the middle 17 of the imaginary straight line 16 that couples the center 26*a* of the first elliptical-shaped recessed portion 26 to the center 27*a* of the second elliptical-shaped recessed portion 27 (formed at a position that bisects the imaginary straight line 16). Then, at this swirl chamber 13, the first elliptical-shaped recessed portion 26 partially overlaps with the second elliptical-shaped recessed portion 27, the first fuel guide channel 18 opens at an end portion side of the long axis 33 of the first elliptical-shaped recessed portion 26 and at an end portion side of the long axis 33 of the first elliptical-shaped recessed portion 26 that does not overlap with the second elliptical-shaped recessed portion 27, and the second fuel guide channel 20 opens at an end portion side of the long axis 34 of the second elliptical-shaped recessed portion 27 and at an end portion side of the long axis 34 of the second elliptical-shaped recessed portion 27 that does not overlap with the first elliptical-shaped recessed portion 26. At elliptical shapes when the first and second elliptical-shaped recessed portions 26 and 27 are viewed in plan view, one main axes are the long axes 33 and 34, and other main axes are the short axes 28 and 30.

As shown in FIG. 11, the first elliptical-shaped recessed portion 26 of the swirl chamber 13 has the sidewall 35 coupled to the channel sidewall 36 of the second fuel guide channel 20 near the first elliptical-shaped recessed portion 26 by the smooth curved surface 37 (a curved surface whose shape in plan view is a semicircle that is convex inward the swirl chamber 13). This curved surface 37 is coupled to the sidewall 35 of the first elliptical-shaped recessed portion 26 on the long axis 33 of the first elliptical-shaped recessed portion 26, and is coupled to the channel sidewall 36 of the second fuel guide channel 20 near the first elliptical-shaped recessed portion 26 on an extended line of the long axis 33 of the first elliptical-shaped recessed portion 26. The second elliptical-shaped recessed portion 27 of the swirl chamber 13 has the sidewall 38 coupled to the channel sidewall 40 of the first fuel guide channel 18 near the second elliptical-shaped recessed portion 27 by the smooth curved surface 41 (a curved surface whose shape in plan view is a semicircle that is convex inward the swirl chamber 13). This curved surface 41 is coupled to the sidewall 38 of the second elliptical-shaped recessed portion 27 on an extended line of the long axis 34 of the second elliptical-shaped recessed portion 27, and is coupled to the channel sidewall 40 of the first fuel guide channel 18 near the second elliptical-shaped recessed portion 27 on the long axis 34 of the second elliptical-shaped recessed portion 27. Then, the first fuel guide channel 18 has the opening portion (coupling portion) 42 into the swirl chamber 13. The opening portion 42 is positioned on the long axis 33 of the first elliptical-shaped recessed portion 26. The second fuel guide channel 20 has the opening portion (coupling portion) 43 into the swirl chamber 13. The opening portion 43 is positioned on the long axis 34 of the second elliptical-shaped recessed portion 27. Then, when the swirl chamber 13 is viewed in plan view, the opening portion 42 of the first fuel guide channel 18 into the first elliptical-shaped recessed portion 26 (the swirl chamber 13) and the opening portion 43 of the second fuel guide channel 20 into the second elliptical-shaped recessed portion 27 (the swirl chamber 13) are positioned to have a dyad symmetry with respect to the middle 17 of the imaginary straight line 16. Intervals between the sidewalls 35 and 38 of the swirl chamber 13 and the nozzle hole 6 are formed to become narrowest (smallest) near a coupling portion of the sidewall 35 to the curved surface 37, and near a coupling portion of the sidewall 38 to the curved surface 41). As a result, a flow of the fuel that performs the swirling movement inside the first elliptical-shaped recessed portion 26 and a flow of the fuel that performs the swirling movement inside the second elliptical-shaped recessed portion 27 act on one another to increase a swirling velocity of the fuel inside the swirl chamber 13.

As shown in FIG. 11, the first fuel guide channel 18 has the swirl-chamber-side coupling portion 45*a* formed as being perpendicular to the long axis 33 of the first elliptical-shaped recessed portion 26. The second fuel guide channel 20 has the swirl-chamber-side coupling portion 45*a* formed as being perpendicular to the long axis 34 of the second elliptical-shaped recessed portion 27. Then, the first and second fuel guide channels 18 and 20 are disposed to extend to an inside of the swirl chamber 13 from the opening portions 42 and 43 into the swirl chamber 13. That is, the first fuel guide channel 18 includes the part (the first in-swirl-chamber fuel guide channel portion) 47 disposed to extend while gradually reducing the channel width (channel cross-sectional area) from the opening portion 42 into the first elliptical-shaped recessed portion 26 to an inside of the first elliptical-shaped recessed portion 26 (from one end of the long axis 33 of the first elliptical-shaped recessed portion 26 to near the coupling portion of the sidewall 35 of the first elliptical-shaped recessed portion 26 to the curved surface 37) along the sidewall 35 of the first elliptical-shaped recessed portion 26. The second fuel guide channel 20 includes the part (the second in-swirl-chamber fuel guide channel portion) 48 disposed to extend while gradually reducing the channel width (channel cross-sectional area) from the opening portion 43 into the second elliptical-shaped recessed portion 27 to an inside of the second elliptical-shaped recessed portion 27 (from one end of the long axis 34 of the second elliptical-shaped recessed portion 27 to near the coupling portion of the sidewall 38 of the second elliptical-shaped recessed portion 27 to the curved surface 41) along the sidewall 38 of the second elliptical-shaped recessed portion 27. When these first in-swirl-chamber fuel guide channel portion 47 and second in-swirl-chamber fuel guide channel portion 48 are viewed in plan view, the internal surfaces 49 at a side of the nozzle hole 6 have smooth arc shapes (arc shapes that are convex in directions identical to the sidewalls 35 and 38, and for example, in a case of a true circle, a circular arc that is a part of the true circle, and in a case of an ellipse, an elliptical arc that is a part of the ellipse). Then, when the swirl chamber 13 is viewed in plan view, the first in-swirl-chamber fuel guide channel portion 47 and the second in-swirl-chamber fuel guide channel portion 48 are formed to have a dyad symmetry with respect to the middle 17 of the imaginary straight line 16. Such first and second in-swirl-chamber fuel guide channel portions 47 and 48 improve the flow in a tangential direction of the nozzle hole 6, of the fuel supplied into the swirl chamber 13 from the first fuel guide channel portions 45, 45 to reduce the flow in a normal direction toward the nozzle hole 6, thus guiding the fuel into the inside of the swirl chamber 13 (parts where the intervals between the sidewalls 35 and 38 of the swirl chamber 13 and the nozzle hole 6 become narrowest) along the sidewalls 35 and 38 of the swirl chamber 13. Then, the flow of the fuel from sides of the first and second in-swirl-chamber fuel guide channel portions 47 and 48 toward the nozzle hole 6 is narrowed down to accelerate by the first and second in-swirl-chamber fuel guide channel portions 47 and 48, which are configured to gradually reduce the channel width, since the first and second in-swirl-chamber fuel guide channel portions 47 and 48 are formed deeper than the swirl chamber 13 (having depths identical to those of the first and second fuel guide channels 18 and 20).

Sixth Embodiment

Figure 12A:
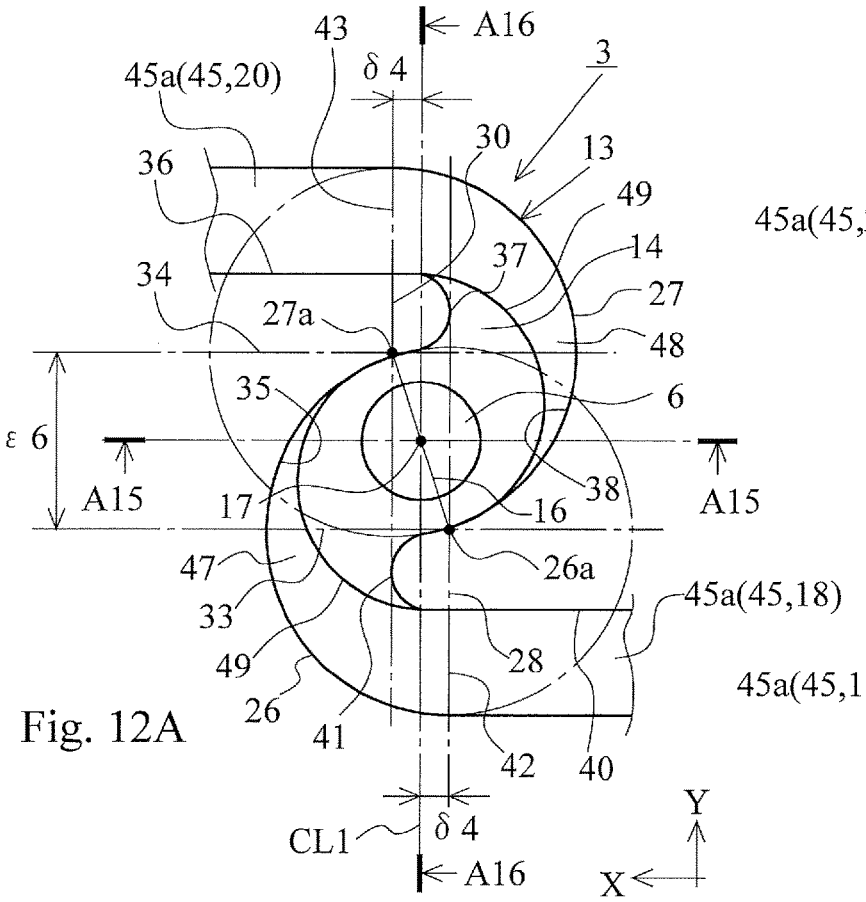
Figure 12C:
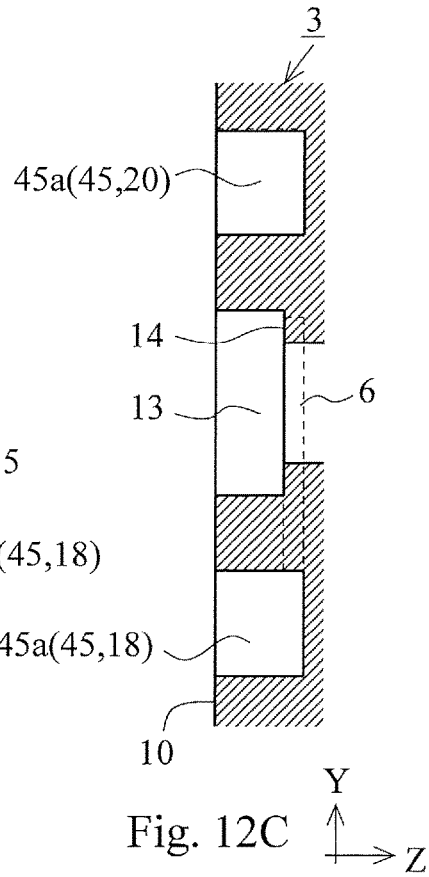
Figure 12B:
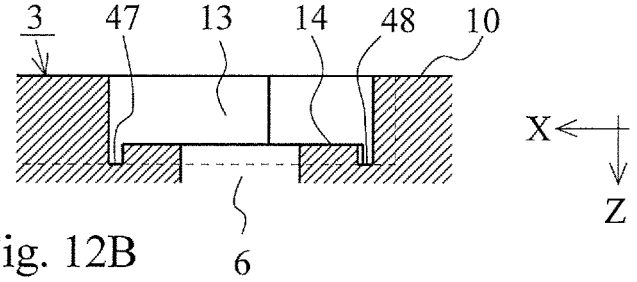

FIG. 12 are detailed views of a swirl chamber 13 of a nozzle plate 3 according to a sixth embodiment of the present invention, and views showing a modification of the swirl chamber 13 according to the fourth embodiment. FIG. 12A is a plan view of the swirl chamber 13, FIG. 12B is a cross-sectional view of the swirl chamber 13 taken along a line A15-A15 in FIG. 12A, and FIG. 12C is a cross-sectional view of the swirl chamber 13 taken along a line A16-A16 in FIG. 12A.

As shown in FIG. 12, the swirl chamber 13 according to the embodiment is different from the swirl chamber 13 according to the fourth embodiment, in that, when the swirl chamber 13 is viewed in plan view, lengths of the short axes (one main axes) 28 and 30 and the long axes (other main axes) 33 and 34 of the first and second elliptical-shaped recessed portions 26 and 27 have identical dimensions, and the first and second elliptical-shaped recessed portions 26 and 27 are formed into circular shapes, but other configuration is common to that of the swirl chamber according to the fourth embodiment. Accordingly, for the swirl chamber 13 shown in FIG. 12, reference numerals identical to the respective configuration parts of the swirl chamber 13 according to the fourth embodiment are assigned to configuration parts common to those of the swirl chamber 13 according to the fourth embodiment, and therefore the following omits the overlapping explanation. At the swirl chamber 13 according to the embodiment, the center 27*a* of the second elliptical-shaped recessed portion 27 is disposed separated from the center 26*a* of the first elliptical-shaped recessed portion 26 along the Y-axis direction by a predetermined dimension (ε6), the center 26*a* of the first elliptical-shaped recessed portion 26 is disposed separated from the center line CL1, which passes through a center of the nozzle hole 6 and is parallel to the Y-axis, in the right direction in the view by a predetermined dimension (δ4), and the center 27*a* of the second elliptical-shaped recessed portion 27 is disposed separated from the center line CL1 in the left direction in the view by the predetermined dimension (δ4). The swirl chamber 13 according to the embodiment having such configuration provides a function similar to that of the swirl chamber 13 according to the fourth embodiment.

Seventh Embodiment

Figure 13A:
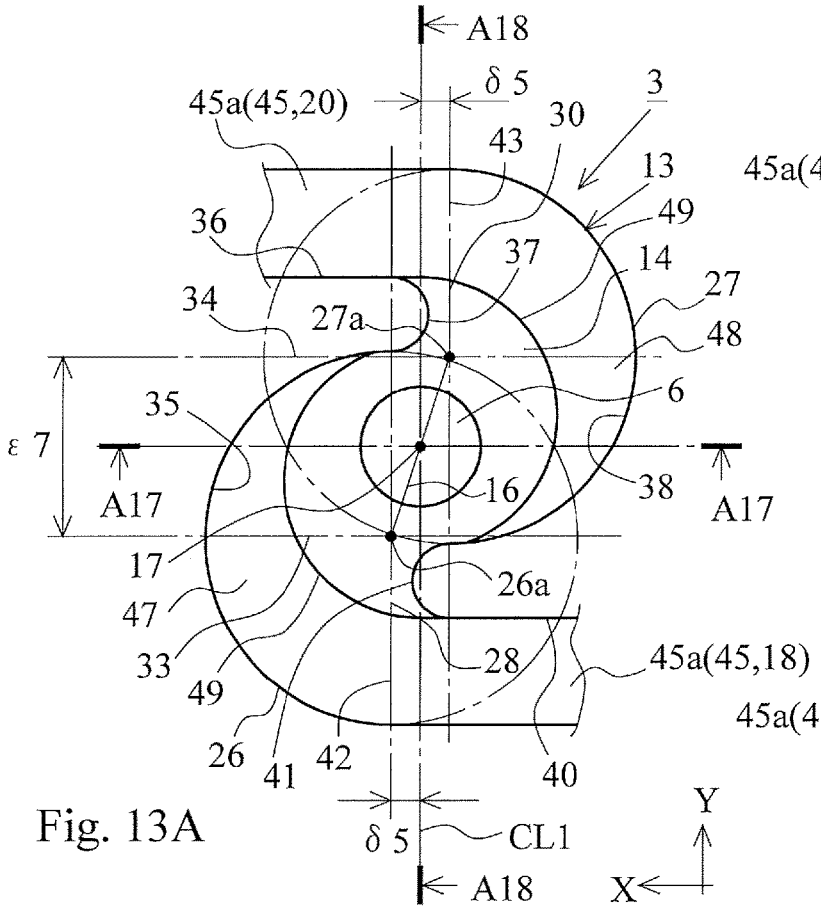
Figure 13C:
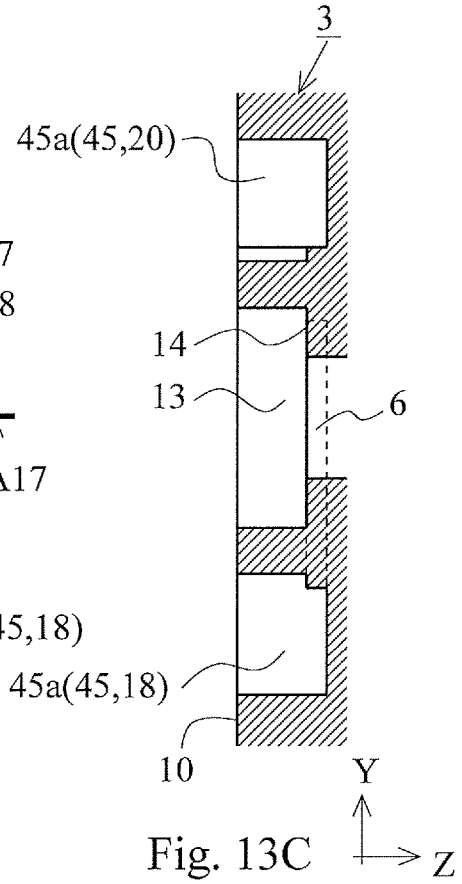
Figure 13B:
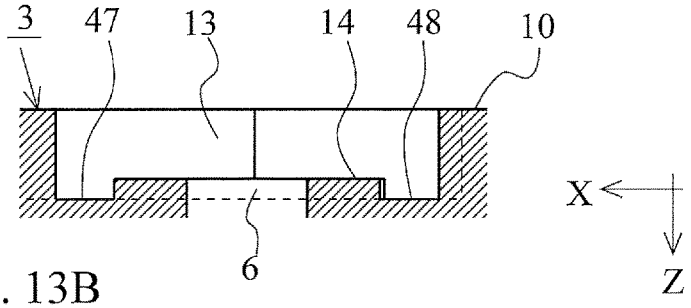

FIG. 13 are detailed views of a swirl chamber 13 of a nozzle plate 3 according to a seventh embodiment of the present invention, and views showing a modification of the swirl chamber 13 according to the fifth embodiment. FIG. 13A is a plan view of the swirl chamber 13, FIG. 13B is a cross-sectional view of the swirl chamber 13 taken along a line A17-A17 in FIG. 13A, and FIG. 13C is a cross-sectional view of the swirl chamber 13 taken along a line A18-A18 in FIG. 13A.

As shown in FIG. 13, the swirl chamber 13 according to the embodiment is different from the swirl chamber 13 according to the fifth embodiment, in that, when the swirl chamber 13 is viewed in plan view, lengths of the short axes (other main axes) 28 and 30 and the long axes (one main axes) 33 and 34 of the first and second elliptical-shaped recessed portions 26 and 27 have identical dimensions, and the first and second elliptical-shaped recessed portions 26 and 27 are formed into circular shapes, but other configuration is common to that of the swirl chamber according to the fifth embodiment. Accordingly, for the swirl chamber 13 shown in FIG. 13, reference numerals identical to the respective configuration parts of the swirl chamber 13 according to the fifth embodiment are assigned to configuration parts common to those of the swirl chamber 13 according to the fifth embodiment, and therefore the following omits the overlapping explanation. At the swirl chamber 13 according to the embodiment, the center 27*a* of the second elliptical-shaped recessed portion 27 is disposed separated from the center 26*a* of the first elliptical-shaped recessed portion 26 along the Y-axis direction by a predetermined dimension (ε7), the center 26*a* of the first elliptical-shaped recessed portion 26 is disposed separated from the center line CL1, which passes through a center of the nozzle hole 6 and is parallel to the Y-axis, in the left direction in the view by a predetermined dimension (δ5), and the center 27*a* of the second elliptical-shaped recessed portion 27 is disposed separated from the center line CL1 in the right direction in the view by the predetermined dimension (δ5). The swirl chamber 13 according to the embodiment having such configuration provides a function similar to that of the swirl chamber 13 according to the fifth embodiment.

Eighth Embodiment

Figure 14A:
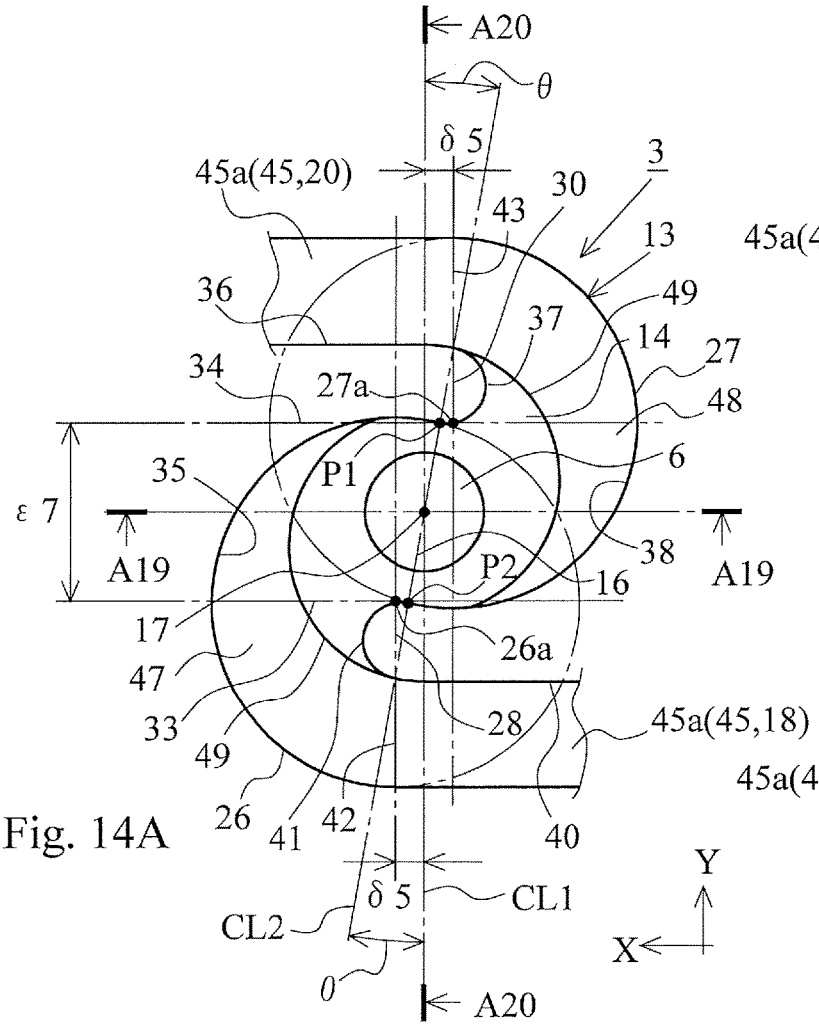
Figure 14C:
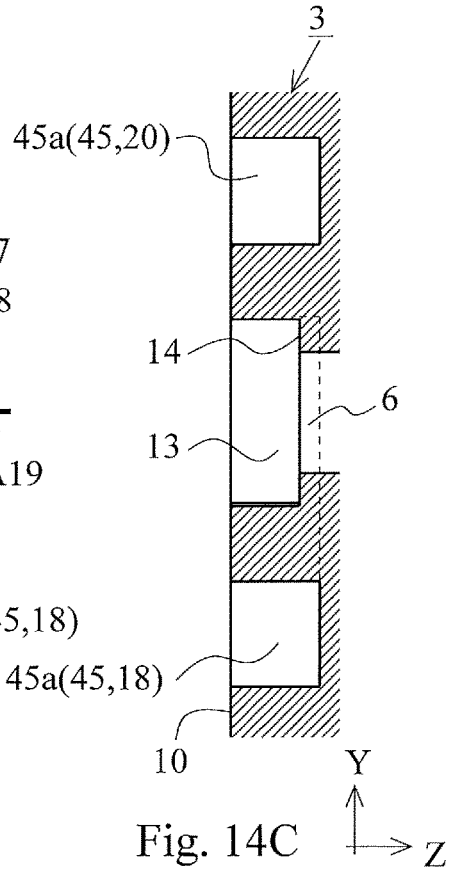
Figure 14B:
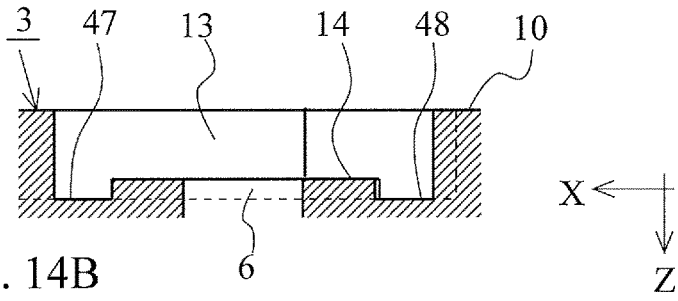
Figure 15A:
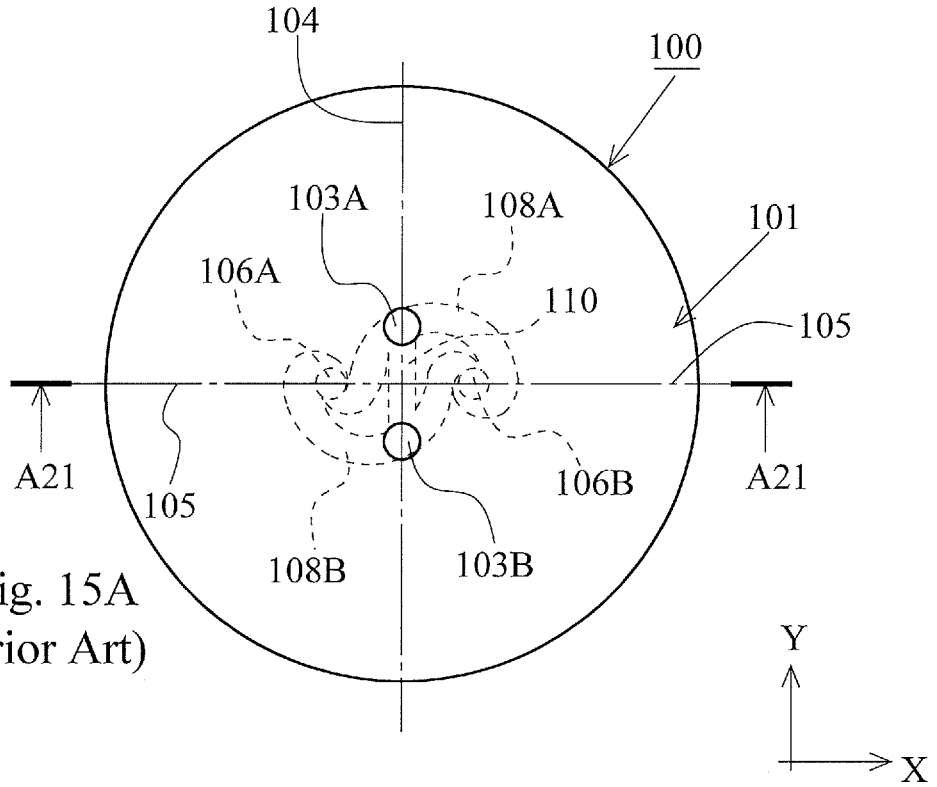
Fig. 15A (Prior Art)
FIGS. 15A and 15B are views showing a conventional nozzle plate.
Figure 15B:
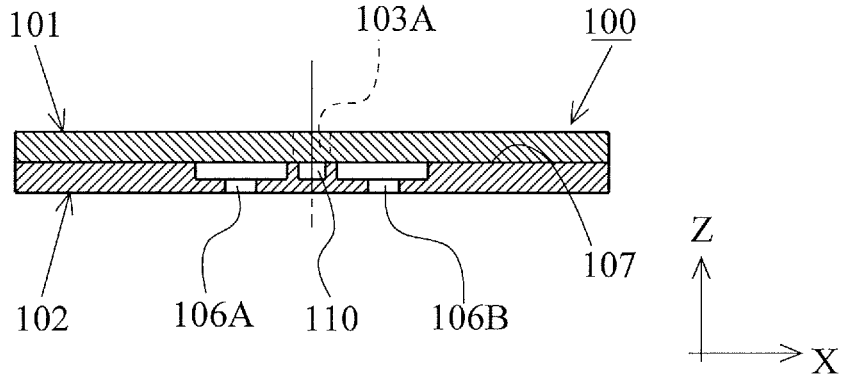
Fig. 15B (Prior Art)
Figure 16A:
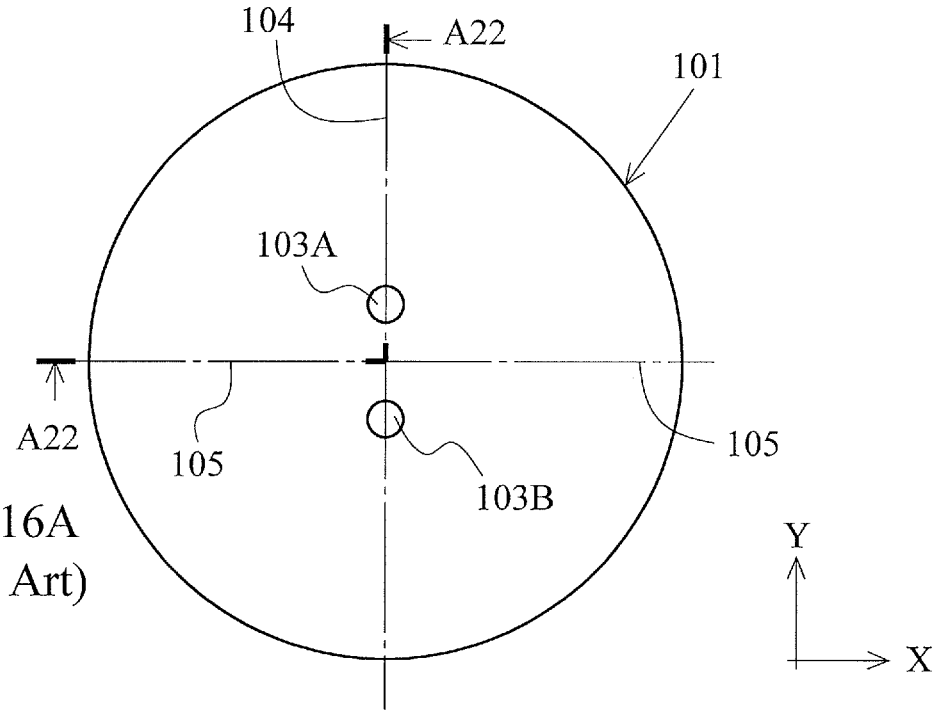
Fig. 16A (Prior Art)
FIGS. 16A and 16B are views showing a first nozzle plate that constitutes the conventional nozzle plate.
Figure 16B:
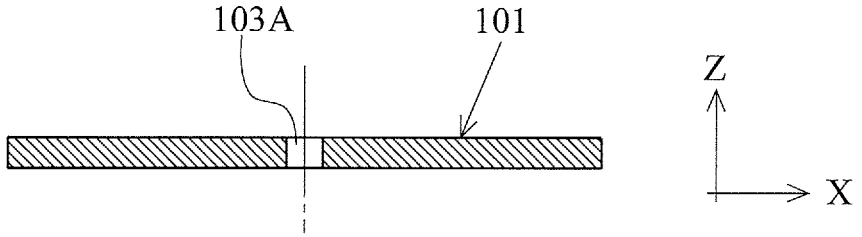
Fig. 16B (Prior Art)
Figure 17A:
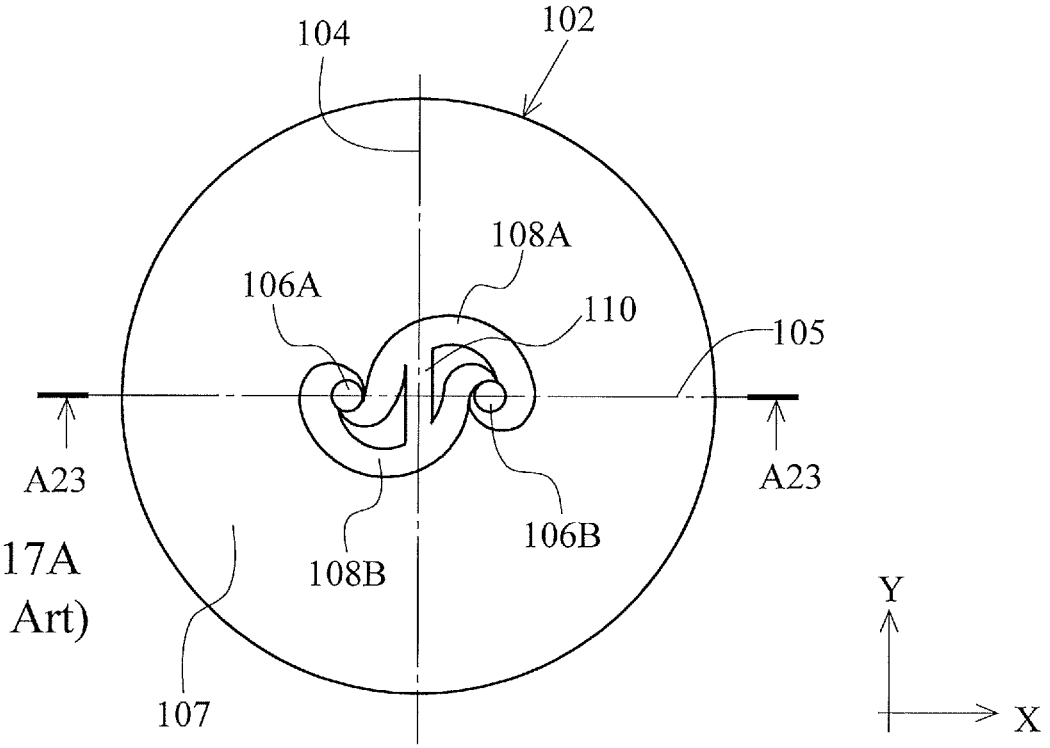
Fig. 17A (Prior Art)
FIGS. 17A and 17B are views showing a second nozzle plate that constitutes the conventional nozzle plate.
Figure 17B:
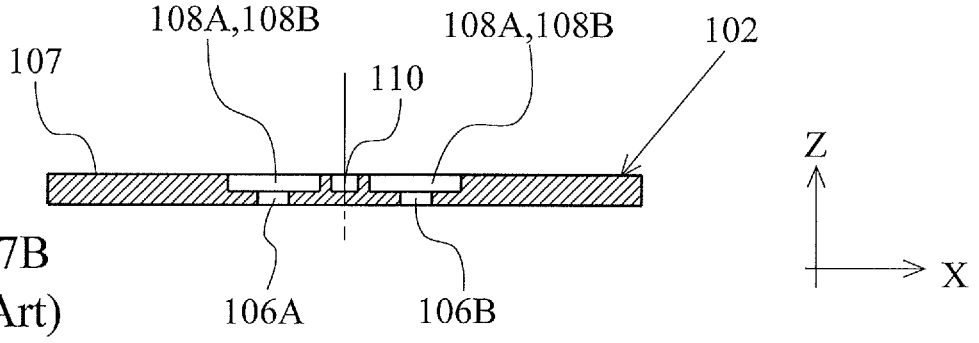
Fig. 17B (Prior Art)

FIG. 14 are detailed views of a swirl chamber 13 of a nozzle plate 3 according to an eighth embodiment of the present invention, and views showing a modification of the swirl chamber 13 according to the seventh embodiment. FIG. 14A is a plan view of the swirl chamber 13, FIG. 14B is a cross-sectional view of the swirl chamber 13 taken along a line A19-A19 in FIG. 14A, and FIG. 14C is a cross-sectional view of the swirl chamber 13 taken along a line A20-A20 in FIG. 14A. In the explanation of the swirl chamber 13 according to the embodiment, the short axes 28 and 30 and the long axes 33 and 34 having identical lengths are described by being replaced to main axes 28, 30, 33, and 34. For the swirl chamber 13 shown in FIG. 14, reference numerals identical to the respective configuration parts of the swirl chamber 13 according to the seventh embodiment are assigned to configuration parts common to those of the swirl chamber 13 according to the seventh embodiment, and therefore the following omits the overlapping explanation.

As shown in FIG. 14A, at the swirl chamber 13 according to the embodiment, compare with the swirl chamber 13 according to the seventh embodiment shown in FIG. 13A, the curved surface 37 is positioned displaced off to a clockwise direction along an outer edge of the first elliptical-shaped recessed portion 26, and the curved surface 41 is positioned displaced off to the clockwise direction along an outer edge of the second elliptical-shaped recessed portion 27. That is, when an imaginary line drawn such that the center line CL1, which passes through a center of the nozzle hole 6 and is parallel to the Y-axis, is turned around the center of the nozzle hole 6 in the clockwise direction by a degree θ is CL2, and an intersection point of this imaginary line CL2 and the outer edge (the sidewall 35) of the first elliptical-shaped recessed portion 26 is P1, the swirl chamber 13 according to the embodiment is configured such that one end of the curved surface 37 is positioned at the intersection point P1, and another end of this curved surface 37 is coupled to the channel sidewall 36 of the second fuel guide channel 20 near the first elliptical-shaped recessed portion 26. At the swirl chamber 13 according to the embodiment, when an intersection point of the imaginary line CL2 and the outer edge (the sidewall 38) of the second elliptical-shaped recessed portion 27 is P2, one end of the curved surface 41 is positioned at the intersection point P2, and another end of this curved surface 41 is coupled to the channel sidewall 40 of the first fuel guide channel 18 near the second elliptical-shaped recessed portion 27. Then, the first in-swirl-chamber fuel guide channel portion 47 extends from one end side of the main axis 28 of the first elliptical-shaped recessed portion 26 to near another end side of the main axis 28 of the first elliptical-shaped recessed portion 26 along the sidewall 35 of the first elliptical-shaped recessed portion 26 and while gradually reducing a channel width. The second in-swirl-chamber fuel guide channel 48 extends from one end side of the main axis 30 of the second elliptical-shaped recessed portion 27 to near another end side of the main axis 30 of the second elliptical-shaped recessed portion 27 along the sidewall 38 of the second elliptical-shaped recessed portion 27 and while gradually reducing a channel width.

The swirl chamber 13 according to the embodiment having such configuration provides a function similar to that of the swirl chamber 13 according to the seventh embodiment. At the swirl chamber 13 according to the embodiment, compare with the swirl chamber 13 according to the seventh embodiment, a length along the sidewall 35 of the first elliptical-shaped recessed portion 26 from the opening portion 42 at a side of the first elliptical-shaped recessed portion 26 of the first fuel guide channel 18 to the curved surface 37 and a length along the sidewall 38 of the second elliptical-shaped recessed portion 27 from the opening portion 43 at a side of the second elliptical-shaped recessed portion 27 of the second fuel guide channel 20 to the curved surface 41 are lengthened. The swirl chamber 13 according to the embodiment, compare with the swirl chamber 13 according to the seventh embodiment, can narrow an interval between the sidewall 35 of the first elliptical-shaped recessed portion 26 and the nozzle hole 6, and can narrow an interval between the sidewall 38 of the second elliptical-shaped recessed portion 27 and the nozzle hole 6.

Other Embodiment

The nozzle plate 3 according to each above-described embodiments is configured to gradually reduce the channel widths of the first and second in-swirl-chamber fuel guide channel portions 47 and 48 toward the distal ends to gradually reduce the channel cross-sectional areas, but is not limited to this. The nozzle plate 3 according to each above-described embodiments may be configured to gradually reduce the channel widths of the first and second in-swirl-chamber fuel guide channel portions 47 and 48 toward the distal ends and gradually reduce channel depths of the first and second in-swirl-chamber fuel guide channel portions 47 and 48 to gradually reduce the channel cross-sectional areas. Such nozzle plate 3 according to the modification can obtain an effect similar to that of the first embodiment.

The nozzle plate 3 according to each above-described embodiment has exemplified an aspect where the nozzle holes 6 are formed at four positions at regular intervals around the center of the plate body portion 8, but is not limited to this. The nozzle holes 6 may be formed at a plurality of positions equal to or more than two positions at regular intervals around the center of the plate body portion 8.

The nozzle plate 3 according to each above-described embodiment may form a plurality of nozzle holes 6 at irregular intervals around the center of the plate body portion 8.

The nozzle plate 3 according to each above-described embodiment has exemplified a case formed by the injection molding, but is not limited to this. The nozzle plate 3 may be formed such that a cutting work or the like is performed to a metal, and may be formed by using a metal injection molding method.

The swirl chamber 13 of the nozzle plate 3 according to each above-described embodiment is configured such that the lengths of the short axes (the main axes) 28 and 30 and the long axes (the main axes) 33 and 34 of the first and second elliptical-shaped recessed portions 26 and 27, and a ratio of the short axes 28 and 30 to the long axes 33 and 34 are determined to optimum numerical values as necessary, corresponding to injection characteristics and the like of required fuel.

The nozzle plate 3 according to the present invention is not limited to the configurations of the above-described respective embodiments and respective modifications, and the configuration may be changed as necessary in a range that can provide the effects of the present invention. For example, when the swirl chamber 13 is viewed in plan view, it is not necessary that the opening portion 42 of the first fuel guide channel 18 into the first elliptical-shaped recessed portion 26 (the swirl chamber 13) and the opening portion 43 of the second fuel guide channel 20 into the second elliptical-shaped recessed portion 27 (the swirl chamber 13) have the dyad symmetry with respect to the middle 17 of the imaginary straight line 16. When the swirl chamber 13 is viewed in plan view, it is not necessary that the first in-swirl-chamber fuel guide channel portion 47 and the second in-swirl-chamber fuel guide channel portion 48 have the dyad symmetry with respect to the middle 17 of the imaginary straight line 16.

DESCRIPTION OF REFERENCE SIGNS

1: Fuel injection device

3: Nozzle plate (Nozzle plate for fuel injection device)

5: Fuel injection port
6: Nozzle hole
13: Swirl chamber
16: Imaginary straight line
17: Middle
18: First fuel guide channel
20: Second fuel guide channel
26: First elliptical-shaped recessed portion
26*a*: Center
27: Second elliptical-shaped recessed portion
27*a*: Center
28, 30: Short axis (Main axis)
33, 34: Long axis (Main axis)
35, 38: Sidewall

The invention claimed is:

1. A nozzle plate for a fuel injection device disposed opposed to a fuel injection port of the fuel injection device, the nozzle plate having a plurality of nozzle holes through which fuel injected from the fuel injection port passes, wherein:

each of the plurality of nozzle holes is coupled to the fuel injection port via a swirl chamber, a first fuel guide channel, and a second fuel guide channel, the first fuel guide channel and the second fuel guide channel open into the swirl chamber, wherein the swirl chamber has a shape formed by combining a first elliptical-shaped recessed portion formed at a side of a surface opposed to the fuel injection port with a second elliptical-shaped recessed portion having a size identical to a size of the first elliptical-shaped recessed portion, each of the first elliptical-shaped recessed portion and the second elliptical-shaped recessed portion having a major axis and a minor axis, a center of the second elliptical-shaped recessed portion being displaced from a center of the first elliptical-shaped recessed portion, the first elliptical-shaped recessed portion partially overlapping with the second elliptical-shaped recessed portion, the first fuel guide channel opening at a first end portion side of the minor axis of the first elliptical-shaped recessed portion that does not overlap with the second elliptical-shaped recessed portion, the second fuel guide channel opening at a first end portion side of the minor axis of the second elliptical-shaped recessed portion that does not overlap with the first elliptical-shaped recessed portion, each of the nozzle holes being positioned at a middle of an imaginary straight line that couples the center of the first elliptical-shaped recessed portion to the center of the second elliptical-shaped recessed portion, and a side of the first elliptical-shaped recessed portion and a side of the second elliptical-shaped recessed portion having rotational symmetry about a center of each of the nozzle holes, wherein the first fuel guide channel extends to an inside of the first elliptical-shaped recessed portion along a sidewall of the first elliptical-shaped recess portion, and has a channel depth deeper than a depth of the first elliptical-shaped recessed portion, a portion of the first fuel guide channel extending to the inside of the first elliptical-shaped recessed portion gradually reducing a channel cross-sectional area along a sidewall of the first elliptical-shaped recessed portion, wherein the second fuel guide channel extends to an inside of the second elliptical-shaped recessed portion along a sidewall of the second elliptical-shaped recessed portion, and has a channel depth deeper than a depth of the second elliptical-shaped recessed portion, a portion of the second fuel guide channel extending to the inside of the second elliptical-shaped recessed portion gradually reducing a channel cross-sectional area along a sidewall of the second elliptical-shaped recessed portion, and wherein the fuel flowing into the swirl chamber from the first fuel guide channel and the second fuel guide channel is introduced into a respective one of the nozzle holes while being swirled in an identical direction inside the swirl chamber.

2. The nozzle plate for the fuel injection device according to claim 1, wherein a part extending to the inside of the first elliptical-shaped recessed portion in the first fuel guide channel and a part extending to the inside of the second elliptical-shaped recessed portion in the second fuel guide channel are formed such that a shape of the swirl chamber viewed in plan view has a rotational symmetry with respect to the middle of the imaginary straight line.

3. The nozzle plate for the fuel injection device according to claim 1, wherein the first fuel guide channel and the second fuel guide channel have curved flow passage parts such that a centrifugal force in a direction separating from the middle of the imaginary straight line acts on a fuel that flows into the swirl chamber.

4. The nozzle plate for the fuel injection device according to claim 1, wherein the first fuel guide channel and the second fuel guide channel are formed such that flow path lengths from the fuel injection port to the swirl-chamber coupling portions are identical.

5. The nozzle plate for the fuel injection device according to claim 1, wherein:

the first fuel guide channel extends while gradually reducing a channel width from the part opened into the first elliptical-shaped recessed portion to the inside of the first elliptical-shaped recessed portion along the sidewall of the first elliptical-shaped recessed portion, and the second fuel guide channel extends while gradually reducing a channel width from the part opened into the second elliptical-shaped recessed portion to the inside of the second elliptical-shaped recessed portion along the sidewall of the second elliptical-shaped recessed portion.

6. The nozzle plate for the fuel injection device according to claim 1, wherein:

the first fuel guide channel extends while gradually reducing a channel width and the channel depth from the part opened into the first elliptical-shaped recessed portion to the inside of the first elliptical-shaped recessed portion along the sidewall of the first elliptical-shaped recessed portion, and the second fuel guide channel extends while gradually reducing a channel width and the channel depth from the part opened into the second elliptical-shaped recessed portion to the inside of the second elliptical-shaped recessed portion along the sidewall of the second elliptical-shaped recessed portion.

7. The nozzle plate for the fuel injection device according to claim 1, wherein the first fuel guide channel and the second fuel guide channel are formed to allow identical amounts of fuel to flow into the swirl chamber from the fuel injection port.

8. The nozzle plate for the fuel injection device according to claim 1, wherein the surface opposed to the fuel injection port is an inner surface, and a separation mark of a gate for injection molding is formed at an outer surface positioned at a side opposed to the inner surface and a part surrounded by the plurality of nozzle holes.

9. A nozzle plate for a fuel injection device disposed opposed to a fuel injection port of the fuel injection device, the nozzle plate having a plurality of nozzle holes through which fuel injected from the fuel injection port passes, wherein:

each of the plurality of nozzle holes is coupled to the fuel injection port via a swirl chamber, a first fuel guide channel, and a second fuel guide channel, the first fuel guide channel and the second fuel guide channel open into the swirl chamber, wherein the swirl chamber has a shape formed by combining a first elliptical-shaped recessed portion formed at a side of a surface opposed to the fuel injection port with a second elliptical-shaped recessed portion having a size identical to a size of the first elliptical-shaped recessed portion, each of the first elliptical-shaped recessed portion and the second elliptical-shaped recessed portion having a major axis and a minor axis, a center of the second elliptical-shaped recessed portion being displaced from a center of the first elliptical-shaped recessed portion, the first elliptical-shaped recessed portion partially overlapping with the second elliptical-shaped recessed portion, the first fuel guide channel opening at a first end portion side of the major axis of the first elliptical-shaped recessed portion that does not overlap with the second elliptical-shaped recessed portion, the second fuel guide channel opening at a first end portion side of the major axis of the second elliptical-shaped recessed portion that does not overlap with the first elliptical-shaped recessed portion, each of the nozzle holes being positioned at a middle of an imaginary straight line that couples the center of the first elliptical-shaped recessed portion to the center of the second elliptical-shaped recessed portion, and a side of the first elliptical-shaped recessed portion and a side of the second elliptical-shaped recessed portion having rotational symmetry about a center of each of the nozzle holes, wherein the first fuel guide channel extends to an inside of the first elliptical-shaped recessed portion along a sidewall of the first elliptical-shaped recess portion, and has a channel depth deeper than a depth of the first elliptical-shaped recessed portion, a portion of the first fuel guide channel extending to the inside of the first elliptical-shaped recessed portion gradually reducing a channel cross-sectional area along a sidewall of the first elliptical-shaped recessed portion, wherein the second fuel guide channel extends to an inside of the second elliptical-shaped recessed portion along a sidewall of the second elliptical-shaped recessed portion, and has a channel depth deeper than a depth of the second elliptical-shaped recessed portion, a portion of the second fuel guide channel extending to the inside of the second elliptical-shaped recessed portion gradually reducing a channel cross-sectional area along a sidewall of the second elliptical-shaped recessed portion, and wherein the fuel flowing into the swirl chamber from the first fuel guide channel and the second fuel guide channel is introduced into a respective one of the nozzle holes while being swirled in an identical direction inside the swirl chamber.

10. The nozzle plate for the fuel injection device according to claim 9, wherein a part extending to the inside of the first elliptical-shaped recessed portion in the first fuel guide channel and a part extending to the inside of the second elliptical-shaped recessed portion in the second fuel guide channel are formed such that a shape of the swirl chamber viewed in plan view has a rotational symmetry with respect to the middle of the imaginary straight line.

11. The nozzle plate for the fuel injection device according to claim 9, wherein the first fuel guide channel and the second fuel guide channel have curved flow passage parts such that a centrifugal force in a direction separating from the middle of the imaginary straight line acts on a fuel that flows into the swirl chamber.

12. The nozzle plate for the fuel injection device according to claim 9, wherein the first fuel guide channel and the second fuel guide channel are formed such that flow path lengths from the fuel injection port to the swirl-chamber are identical.

13. The nozzle plate for the fuel injection device according to claim 9, wherein:

the first fuel guide channel extends while gradually reducing a channel width from the part opened into the first elliptical-shaped recessed portion to the inside of the first elliptical-shaped recessed portion along the sidewall of the first elliptical-shaped recessed portion, and the second fuel guide channel extends while gradually reducing a channel width from the part opened into the second elliptical-shaped recessed portion to the inside of the second elliptical-shaped recessed portion along the sidewall of the second elliptical-shaped recessed portion.

14. The nozzle plate for the fuel injection device according to claim 9, wherein: the first fuel guide channel extends while gradually reducing a channel width and the channel depth from the part opened into the first elliptical-shaped recessed portion to the inside of the first elliptical-shaped recessed portion along the sidewall of the first elliptical-shaped recessed portion, and the second fuel guide channel extends while gradually reducing a channel width and the channel depth from the part opened into the second elliptical-shaped recessed portion to the inside of the second elliptical-shaped recessed portion along the sidewall of the second elliptical-shaped recessed portion.

15. The nozzle plate for the fuel injection device according to claim 9, wherein the first fuel guide channel and the second fuel guide channel are formed to allow identical amounts of fuel to flow into the swirl chamber from the fuel injection port.

16. The nozzle plate for the fuel injection device according to claim 9, wherein the surface opposed to the fuel injection port is an inner surface, and a separation mark of a gate for injection molding is formed at an outer surface positioned at a side opposed to the inner surface and a part surrounded by the plurality of nozzle holes.

* * * * *